US007171722B2

(12) United States Patent
Keller

(10) Patent No.: US 7,171,722 B2
(45) Date of Patent: Feb. 6, 2007

(54) HEATED VACUUM CARPET CLEANING AND DRYING APPARATUS

(76) Inventor: Kris D. Keller, 826 S. College Ave., College Place, WA (US) 99324

( * ) Notice: Subject to any disclaimer, the term of this patent is extended or adjusted under 35 U.S.C. 154(b) by 275 days.

(21) Appl. No.: 10/340,509

(22) Filed: Jan. 10, 2003

(65) Prior Publication Data

US 2003/0097727 A1 May 29, 2003

Related U.S. Application Data

(60) Division of application No. 09/797,917, filed on Mar. 1, 2001, now Pat. No. 6,505,379, which is a continuation-in-part of application No. 09/556,242, filed on Apr. 24, 2000, now Pat. No. 6,449,799, which is a continuation of application No. 09/042,894, filed on Mar. 16, 1998, now Pat. No. 6,052,861.

(51) Int. Cl.
*A47L 11/30* (2006.01)
*A47L 11/34* (2006.01)

(52) U.S. Cl. ..... 15/322

(58) Field of Classification Search ..... 15/320, 15/321, 322, 345, 346; 134/21, 26, 31, 30, 134/36, 40, 42
See application file for complete search history.

(56) References Cited

U.S. PATENT DOCUMENTS

| | | | | | |
|---|---|---|---|---|---|
| 1,211,948 | A | | 1/1917 | Koster et al. | 15/320 |
| 3,273,193 | A | | 9/1966 | Soderholm et al. | 15/320 |
| 3,484,890 | A | | 12/1969 | Case | 15/346 |
| 3,663,984 | A | | 5/1972 | Anthony et al. | 15/321 |
| 3,747,155 | A | | 7/1973 | Koellisch | 15/322 |
| 3,774,262 | A | | 11/1973 | Anthony et al. | 15/322 |
| 3,840,935 | A | * | 10/1974 | Fitzgerald et al. | 15/322 |
| 3,940,826 | A | | 3/1976 | Phillips et al. | 15/320 |
| 3,964,925 | A | * | 6/1976 | Burgoon | 134/21 |
| 4,073,030 | A | * | 2/1978 | Albishausen | 15/322 |
| 4,333,205 | A | | 6/1982 | Woodward et al. | 15/345 |
| 4,476,607 | A | | 10/1984 | Ross | 15/339 |
| 4,485,519 | A | | 12/1984 | Collier | 15/339 |
| 4,554,698 | A | | 11/1985 | Rennecker et al. | 15/246.3 |
| 4,595,420 | A | | 6/1986 | Williams et al. | 15/320 |
| 4,649,594 | A | * | 3/1987 | Grave | 15/322 |
| 4,658,464 | A | * | 4/1987 | Sharp | 15/321 |
| 4,720,889 | A | * | 1/1988 | Grave | 15/322 |
| 4,782,551 | A | * | 11/1988 | Ballwebber | 15/321 |
| 4,884,315 | A | | 12/1989 | Ehnert | 15/346 |

(Continued)

*Primary Examiner*—Terrence R. Till
(74) *Attorney, Agent, or Firm*—Gregory IP Law; Randy A. Gregory

(57) ABSTRACT

A vacuum cleaning and/or drying systems having heaters which provide drying air to aid in drying or combined cleaning and drying. The system is particularly adapted and beneficial for use on carpets, but can also be used to clean other surfaces such as smooth floors or upholstery. The heaters are on a portable cleaning unit used within the room being cleaned. A support unit is preferably provided outside the room or building to generate vacuum and remove moisture from the room. The support unit is typically mounted on a vehicle and can provide compressed air or other gases and cleaning fluids. Compressed air can be used to agitate and facilitate both cleaning and drying. Compressed air can also be used to apply one or more additives, such as deodorizers and fragrances. The portable unit can also be used for drying flooded carpets and the like.

1 Claim, 23 Drawing Sheets

U.S. PATENT DOCUMENTS 4,939,808 A * 7/1990 Roden et al. ..... 15/322
4,976,005 A * 12/1990 Graye ..... 15/322
4,984,328 A * 1/1991 Berfield ..... 15/322
5,157,805 A * 10/1992 Pinter ..... 15/322
5,168,599 A * 12/1992 Williams ..... 372/69
5,208,940 A 5/1993 London et al. ..... 15/345
5,289,610 A * 3/1994 Monson ..... 15/320
5,457,848 A 10/1995 Miwa ..... 15/346
5,548,866 A * 8/1996 Reed et al. ..... 15/320
5,553,347 A 9/1996 Inoue et al. ..... 15/346
5,561,884 A * 10/1996 Nijland et al. ..... 15/321
5,589,080 A * 12/1996 Cho et al. ..... 210/791
5,640,739 A * 6/1997 Campbell ..... 15/321
5,839,155 A 11/1998 Berglund et al. ..... 15/321
5,891,198 A * 4/1999 Pearlstein ..... 8/158
5,970,574 A * 10/1999 Thrash, Jr. ..... 15/321
6,052,861 A * 4/2000 Keller ..... 15/321
6,173,473 B1 1/2001 Miwa ..... 15/345
6,449,799 B1 * 9/2002 Keller ..... 15/322
6,505,379 B2 * 1/2003 Keller ..... 15/339

* cited by examiner 224
222
201
250
251
261
260
263
206
265
240
218
216
212
214
220
221
222
204
230
228
226
217
210
208
209
202
200

HEATED VACUUM CARPET CLEANING AND DRYING APPARATUS

CROSS-REFERENCE TO RELATED CASES

This application is a divisional of U.S. patent application Ser. No. 09/797,917, filed Mar. 1, 2001, (U.S. Pat. No. 6,505,379). Ser. No. 09/797,917 was a continuation-in-part of application Ser. No. 09/556,242, filed Apr. 24, 2000, (U.S. Pat. No. 6,449,799). Ser. No. 09/556,242 was a continuation of application Ser. No. 09/042,894, filed Mar. 16, 1998, (U.S. Pat. No. 6,052,861). Priority under 35 U.S.C. §120 is claimed.

TECHNICAL FIELD

The technical field of this invention is vacuum cleaning apparatus with heated drying gas and cleaning fluid application, such as used to clean and dry carpeting.

BACKGROUND OF THE INVENTION

Vacuum cleaners make use of vacuum pressures to draw air and entrained debris into the vacuum cleaner. Vacuum cleaners often have a distinct cleaning head having an intake port through which vacuum is applied to remove such debris. The removed debris is then conveyed through a vacuum line and into a collection device.

In the past, many different forms of vacuum cleaner heads and vacuum cleaning systems have been developed to aid in cleaning and debris collection. One area of particular significance is the cleaning of carpeting. The time and money spent in the cleaning of carpets is huge. Regular cleaning occurs using dry vacuum cleaners on a daily or weekly basis in most buildings and homes. Providing more efficient and effective carpet cleaning apparatus is of great significance because of the large amount of time and resources expended, and the potential savings in labor. Also significant is the added enjoyment of having clean carpets.

Commercial carpet cleaners often make use of cleaning fluids in combination with vacuum removal of debris. The cleaning fluids are applied to the area being cleaned, usually by spraying a liquid under pressure. The cleaning liquid or other cleaning fluid is most typically applied immediate ahead of the vacuum intake area. The vacuum intake then picks up the applied cleaning fluids and debris. The cleaning fluids help to solubilize or otherwise loosen soil or other materials that have become attached to the carpet or other surface being cleaned.

In the commercial carpet cleaning field, the favored cleaning systems use relatively greater vacuum pressures generated in an auxiliary support unit. The auxiliary support unit or units are often mounted in a truck, van or other suitable vehicle. The auxiliary support units are mounted in vehicles to provide an easily transportable support station with self-contained power. This allows increased ability to generate vacuum pressures and allows pumping of cleaning fluids. The vehicles holding the support units are parked at curbside and vacuum and cleaning fluid hoses are run into the building to the location where the carpet is being cleaned.

This auxiliary support unit configuration allows greater vacuums to be developed than what can be developed using normal electrical circuits and portable vacuum generators which are carried into the building and plugged into the building electrical supply. This is true because generating vacuums and pumping fluids require significant amounts of energy which may overload a typical circuit causing a fuse or breaker to de-energize the circuit. The vehicle mounted units typically use the vehicle motor as a primary mover, or may include auxiliary engines that provide the mechanical power to generate the vacuum and pump the fluids.

The vehicle mounted auxiliary support unit configuration is beneficial because it allows the vacuum pressures and cleaning fluids to be conveyed by flexible conduit laid into the building. This eliminates the work associated with moving the vacuum generators into and out from the building. It also allows powered supply of the cleaning fluids and powered vacuum withdrawal of the spent cleaning fluids via these conduits so that direct human handling is not needed.

Even though carpet cleaning systems laving vehicle mounted auxiliary support units are powerful, there remains a number of significant problems in the industry. Current systems are deficient in not providing a dry carpet, upholstery or other surface when the cleaning job is done. The carpets are not immediately dry, nor are they dry a short time after being cleaned. Instead, the carpets remain wet often for 1 or 2 days. This long drying period may be necessary even through large drying fans are used.

This problem of wet carpets has in particular plagued the commercial carpet cleaning business. It has also impeded the commercial upholstery cleaning business. In both areas the customers are disappointed that the carpets or upholstery are left wet by necessity. This often renders the cleaned areas unusable or unpleasant, depending on the situation.

The current practice of leaving carpets wet also makes the demand for carpet cleaning services decline in cold weather. In cold weather it is even more difficult to dry the carpets and this unpleasant condition lasts even longer. As a result, most parties do not clean carpets during winter weather.

Another longstanding major problem is that many current wet carpet cleaning systems also do not provide sufficiently effective cleaning. This is a limitation even though they are helpful and usually superior to dry vacuum systems. This limited effectiveness in cleaning, frequently results in residual stains and/or odor problems that are not removed in one cleaning session.

It is also a common problem that wet carpet cleaning systems bring out various odors which have built up in the carpet. The odors may persist until the carpet is fully dry which in many cases can last 1–2 days from the time of cleaning during favorable conditions. During cold weather the odors may persist even longer. This problem further deters people from having carpets cleaned unless conditions are favorable, such as in warm or dry weather.

In commercial buildings which do not have windows that open, these odors and the residual moisture of the drying carpet can remain in the building and pose indoor air quality problems. Moisture left for days can lead to molds and mildew which may aggravate or cause allergy problems.

Another problem area concerns drying of carpet and upholstery after flooding has occurred. Many basements flood for various reasons. If carpets are laid in such areas, then the carpets soak up water and other undesirable matter. This often leaves carpeting unusable and it must be replaced because there is no sufficient cleaning techniques.

Flood waters carry large amounts of entrained dirt and debris. This matter is infused into the carpet by the flood waters. Flood water damage to carpet and upholstery are also extremely difficult to fully remedy. People who have suffered such problems often find that the carpet is never again truly clean. Lingering odors persist and may only be alleviated by removal of the flooded carpet and replacement with new carpet.

Additionally, many basements experience a dampness problem without specific flooding. This common problem typically leads to molds and mildew forming. This and other microbes or small creatures, such as house mites, may develop and stain carpet or leave it with odors that are unpleasant. They additionally pose allergy problems for some people and may be of general derogatory effect on the health of the inhabitants. Prior carpet cleaning systems have not been sufficiently effective to overcome these problems.

Because of these longstanding and persistent problems, there remains a need for a carpet cleaning system which can very effectively clean carpets. There is also a keen need for a carpet cleaning system which can clean carpets and leave them dry immediately after use.

These and other objectives and considerations have been fully or partially addressed by the current invention, which is described in detail below. Some of the benefits and advantages of the current invention will be given in this description. Others will be apparent from the nature of the invention when considered in conjunction with the description given herein. Although effort is made to fully describe the invention and it's various benefits, advantages and principals of operation; some of such information may not be evident or available at this time. In the future such may become evident after additional experience is gained using the invention. The best modes of the invention and various features and advantages now known are described herein.

BRIEF DESCRIPTION OF THE DRAWINGS

Preferred embodiments of the invention are described below with reference to the accompanying drawings, which are briefly described below.

First Embodiment

FIG. 1 is a diagrammatic view illustrating a preferred form of the present invention in operation.

FIG. 4 is an enlarged cross-sectional view taken substantially along line 4—4 in FIG. 2.

Second Embodiment

Figure 11:
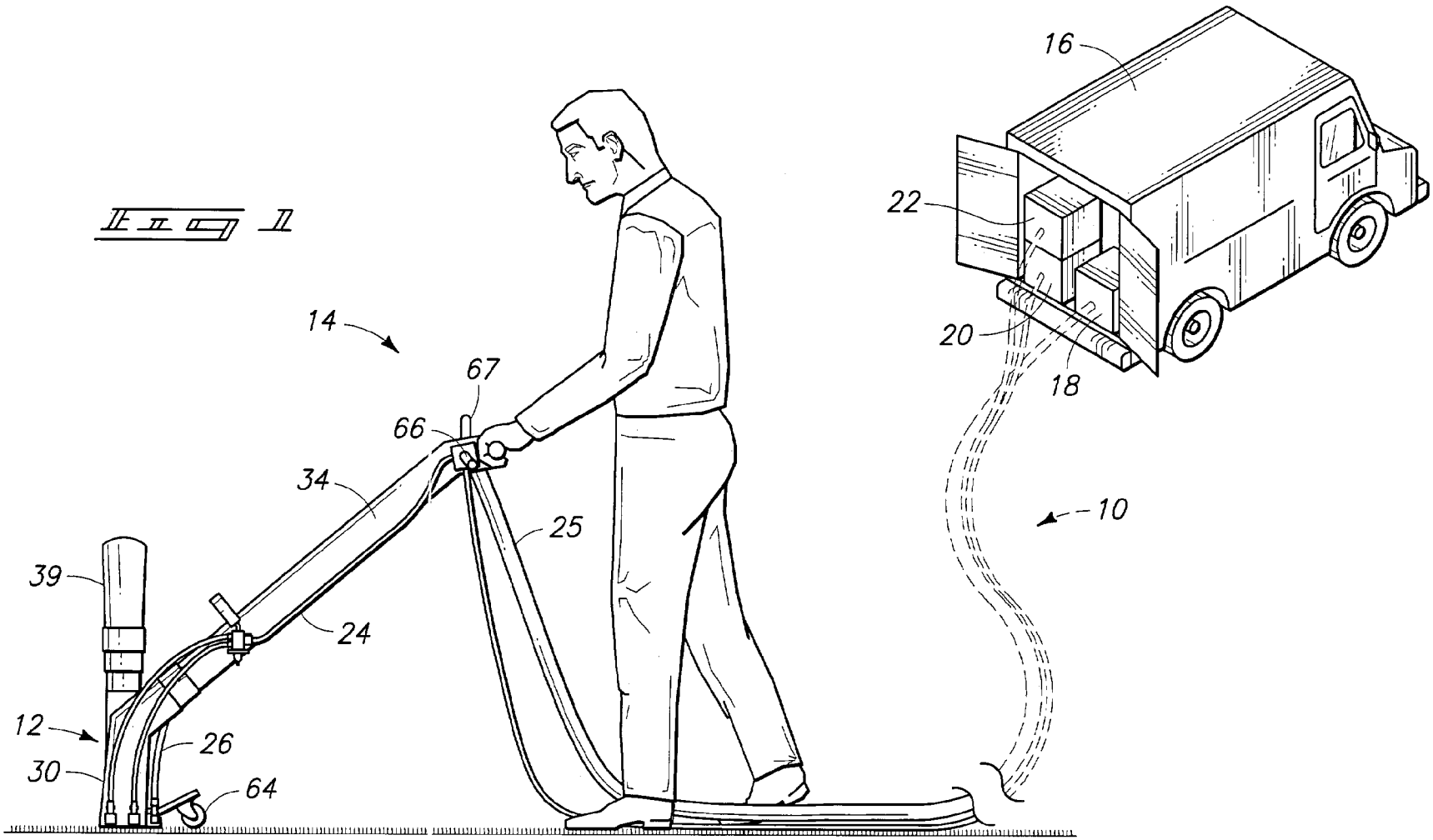
Figure 3:
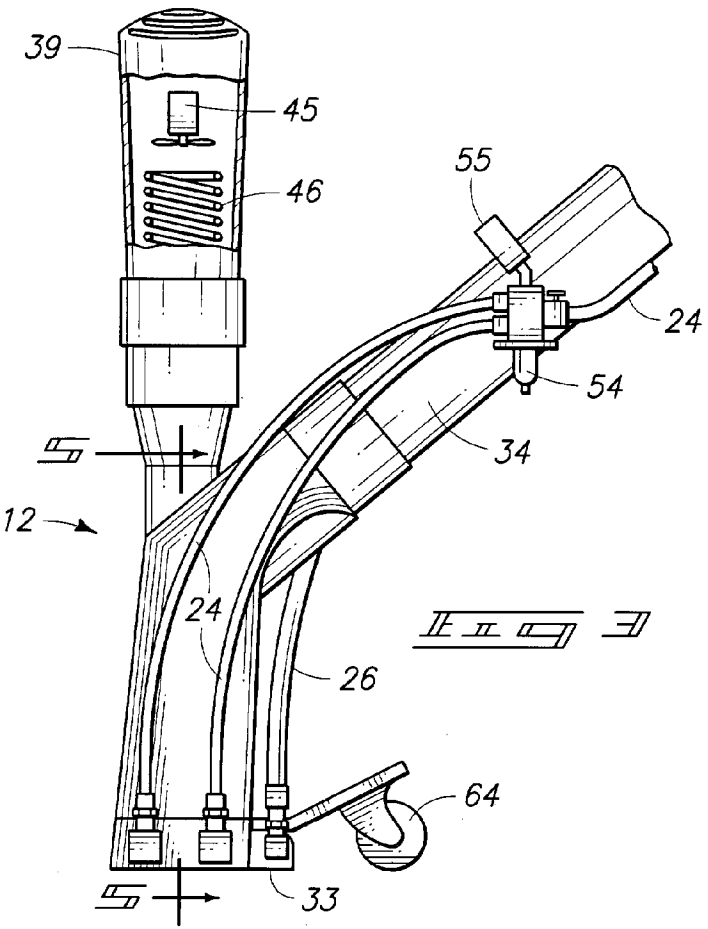
FIG. 3 is a fragmented side elevational view from the right in FIG. 2.
Figure 2:
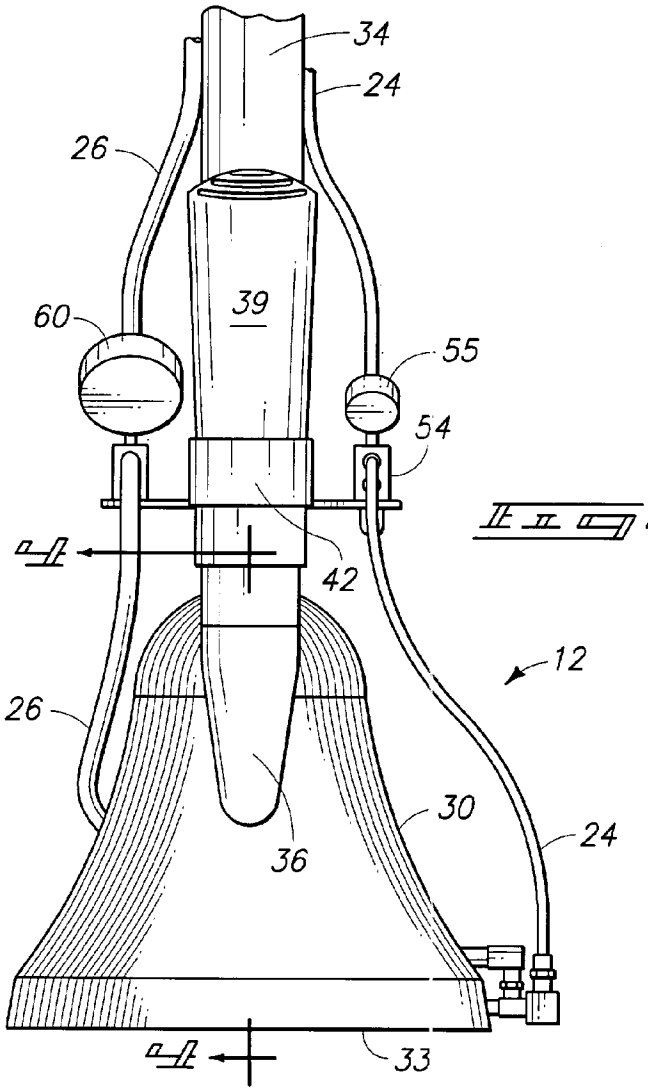
FIG. 2 is a fragmented front end elevational view of a preferred cleaning lead.
Figures 10, 11:
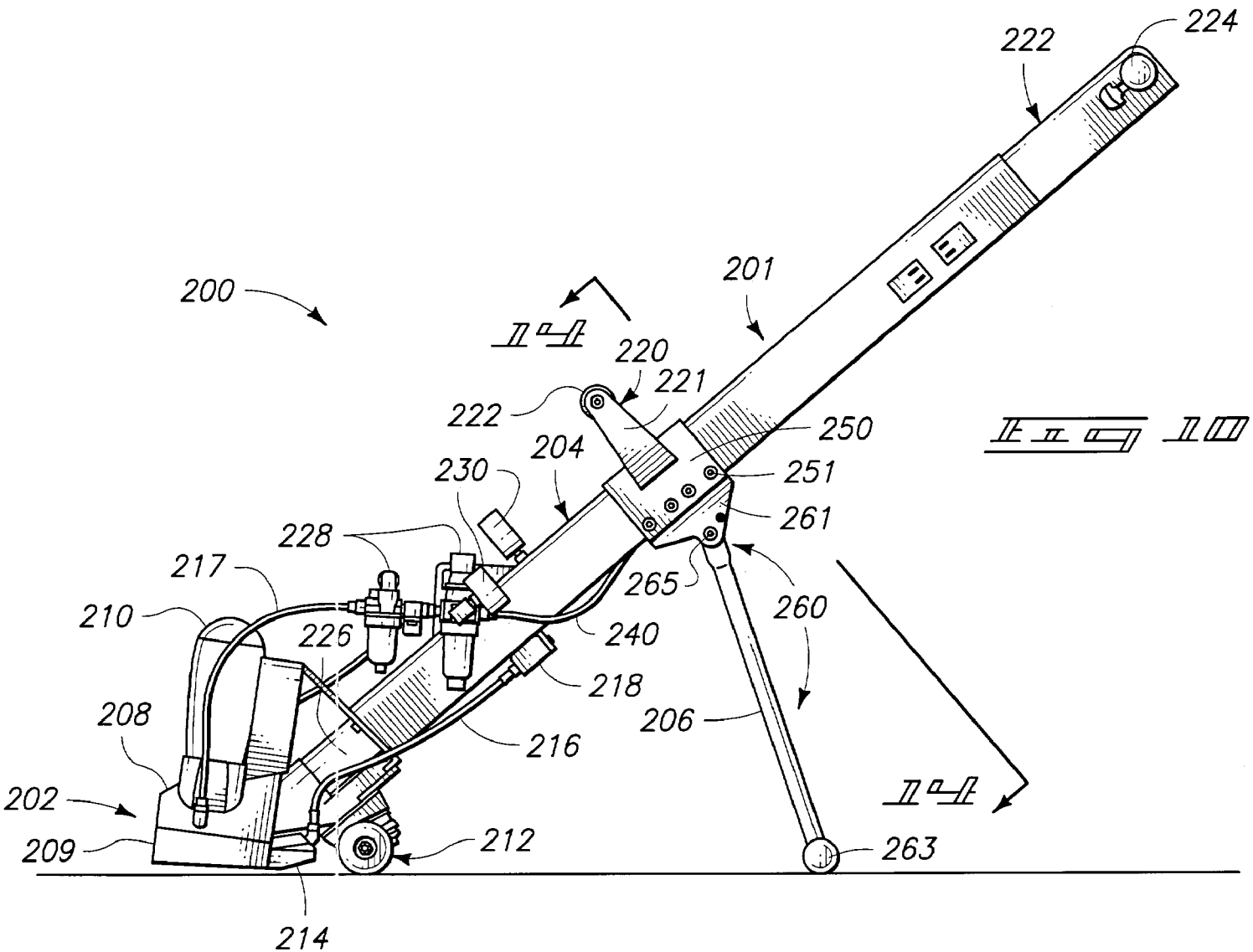
Figure 11:
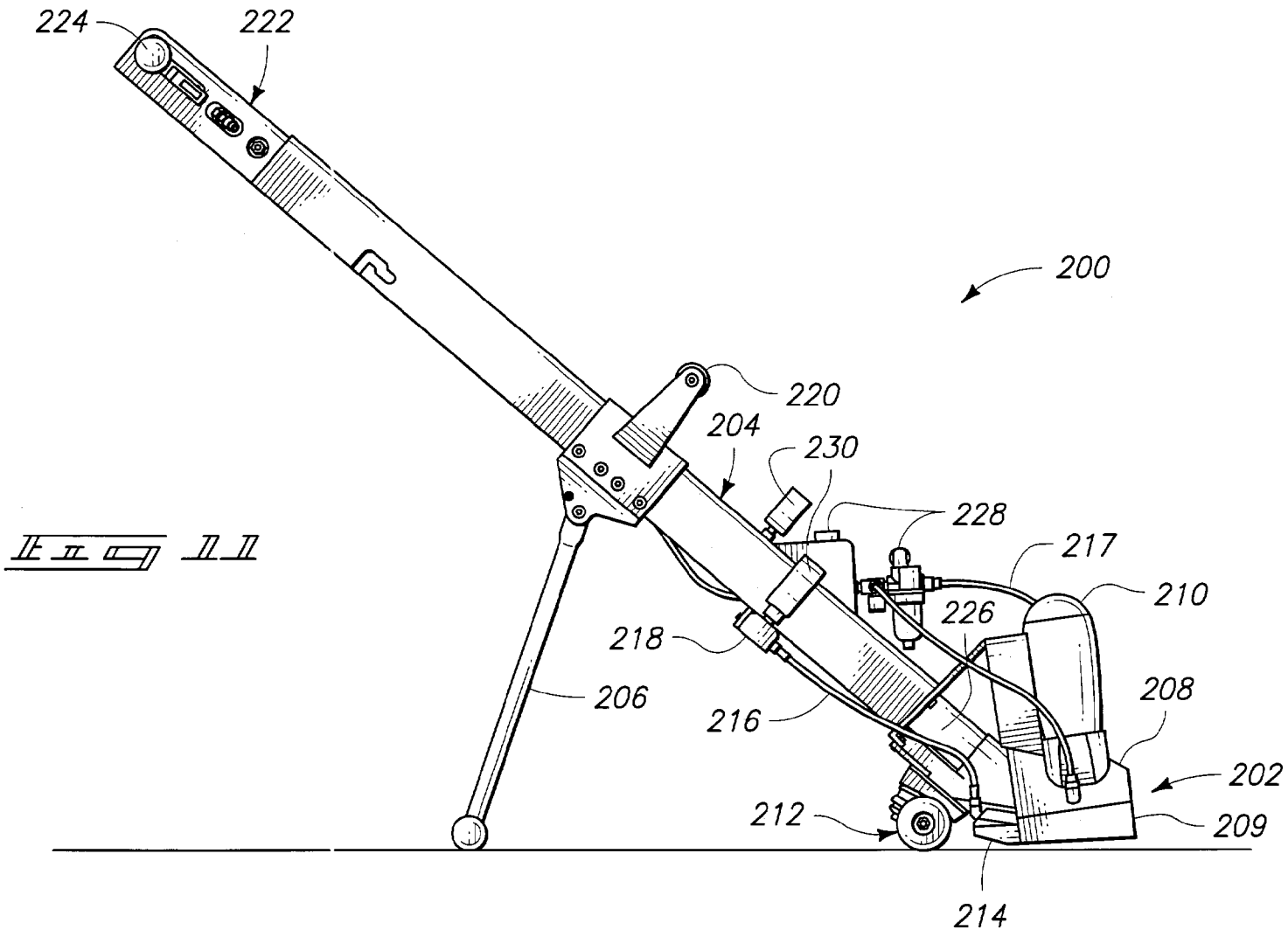

FIG. 10 is a side elevational view showing a second embodiment of portable unit according to the invention.

FIG. 11 is a side elevational view of the second embodiment of FIG. 10 taken from the opposite side.

Figure 12:
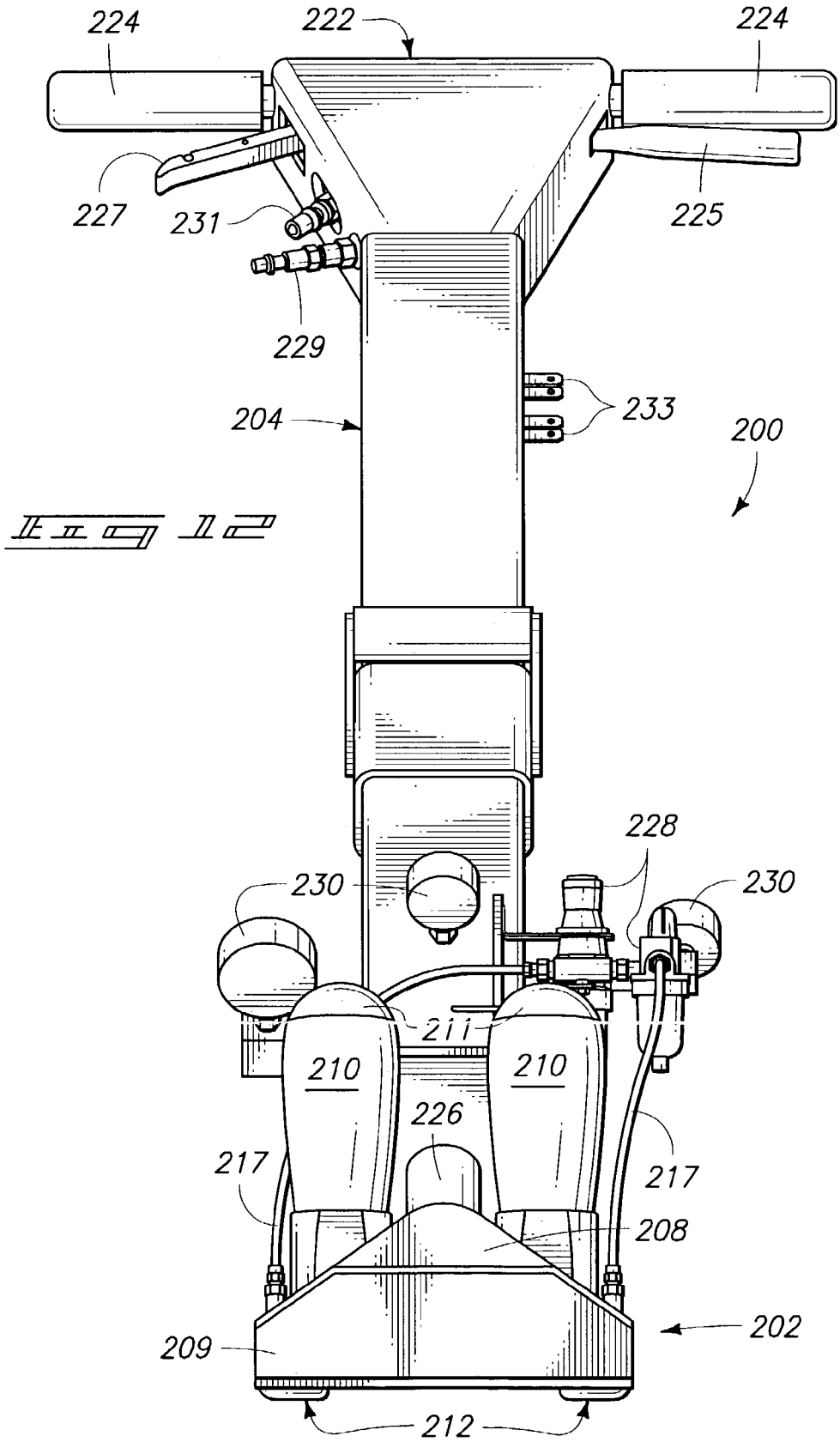
Figure 11:
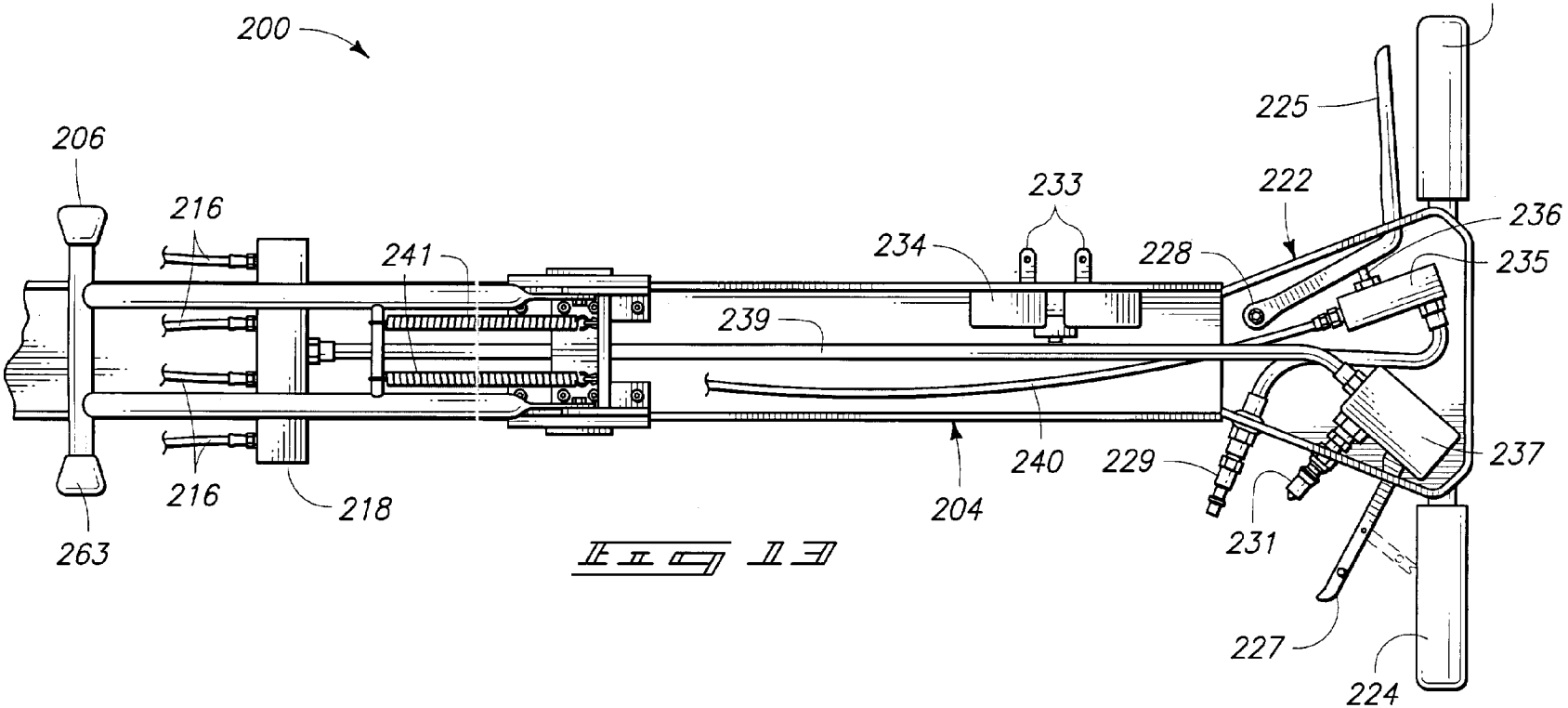
Figure 11:
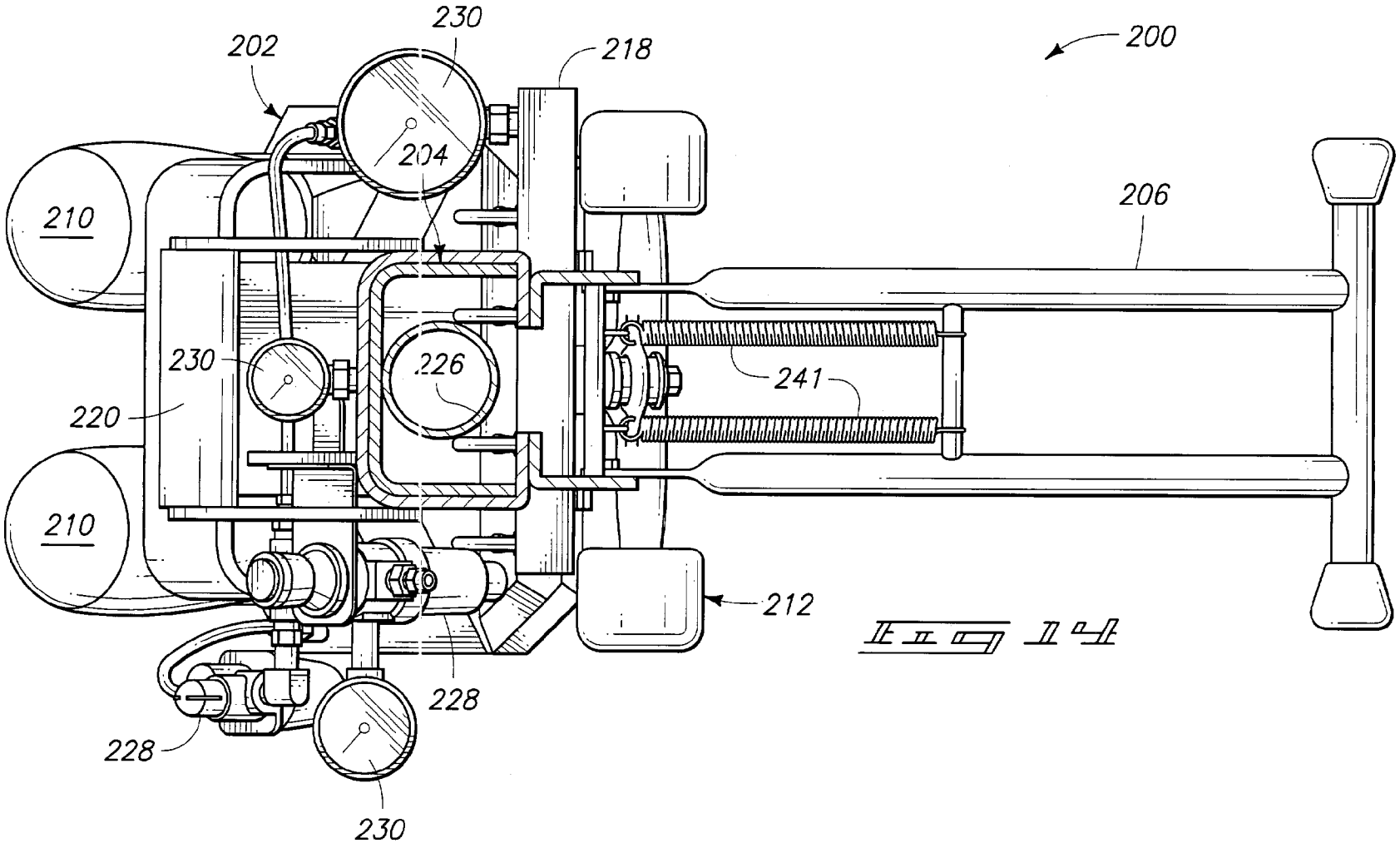

FIG. 12 is a front elevational view of the second embodiment shown in FIG. 10.

FIG. 13 is a partial rear view of the second embodiment taken along a view line perpendicular to the upper portion of the portable unit.

FIG. 14 is a sectional view taken along line 14—14 of FIG. 10.

Figure 15:
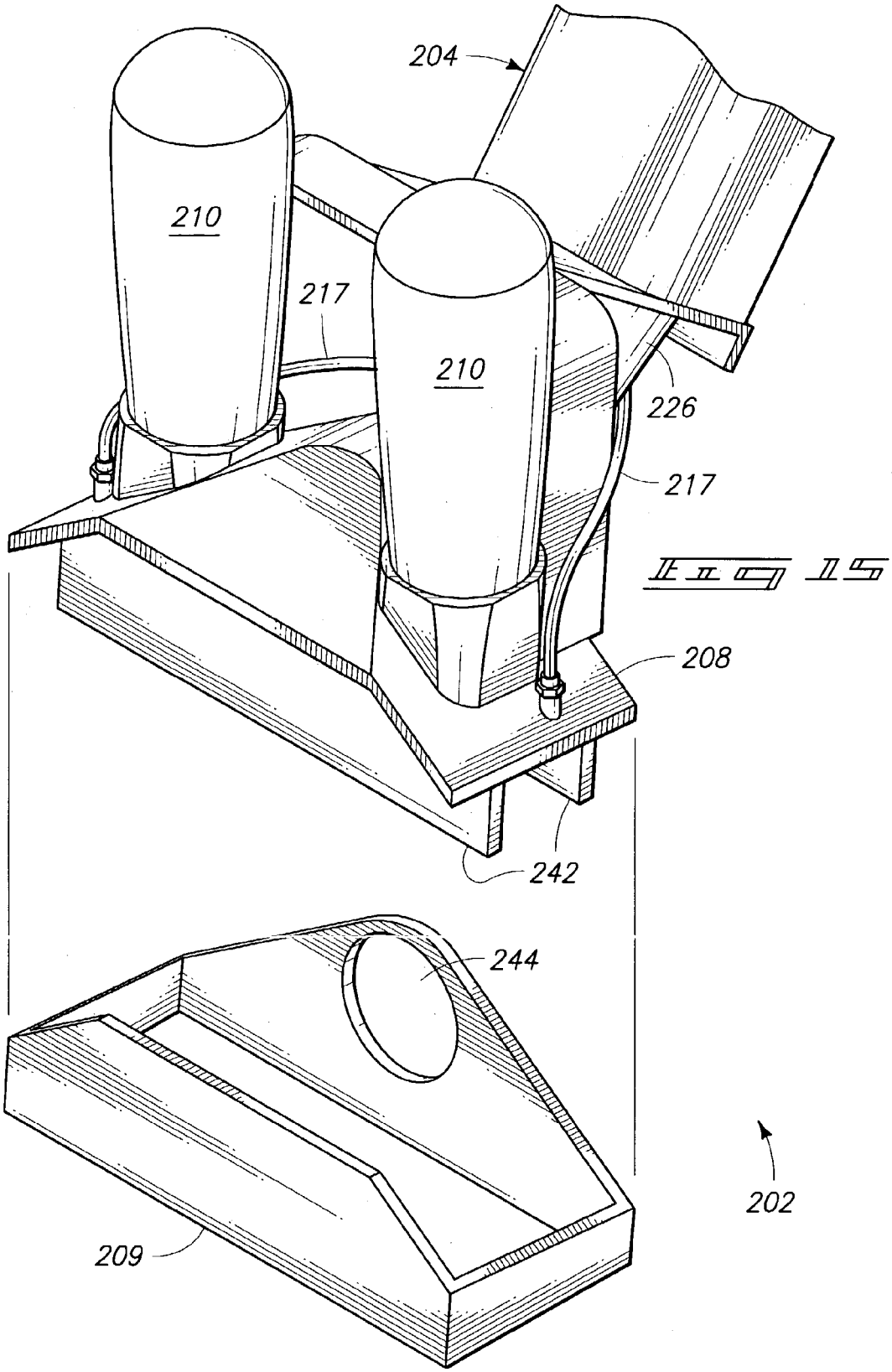

FIG. 15 is an exploded perspective view showing one manner of construction used in the second embodiment.

Figure 16:
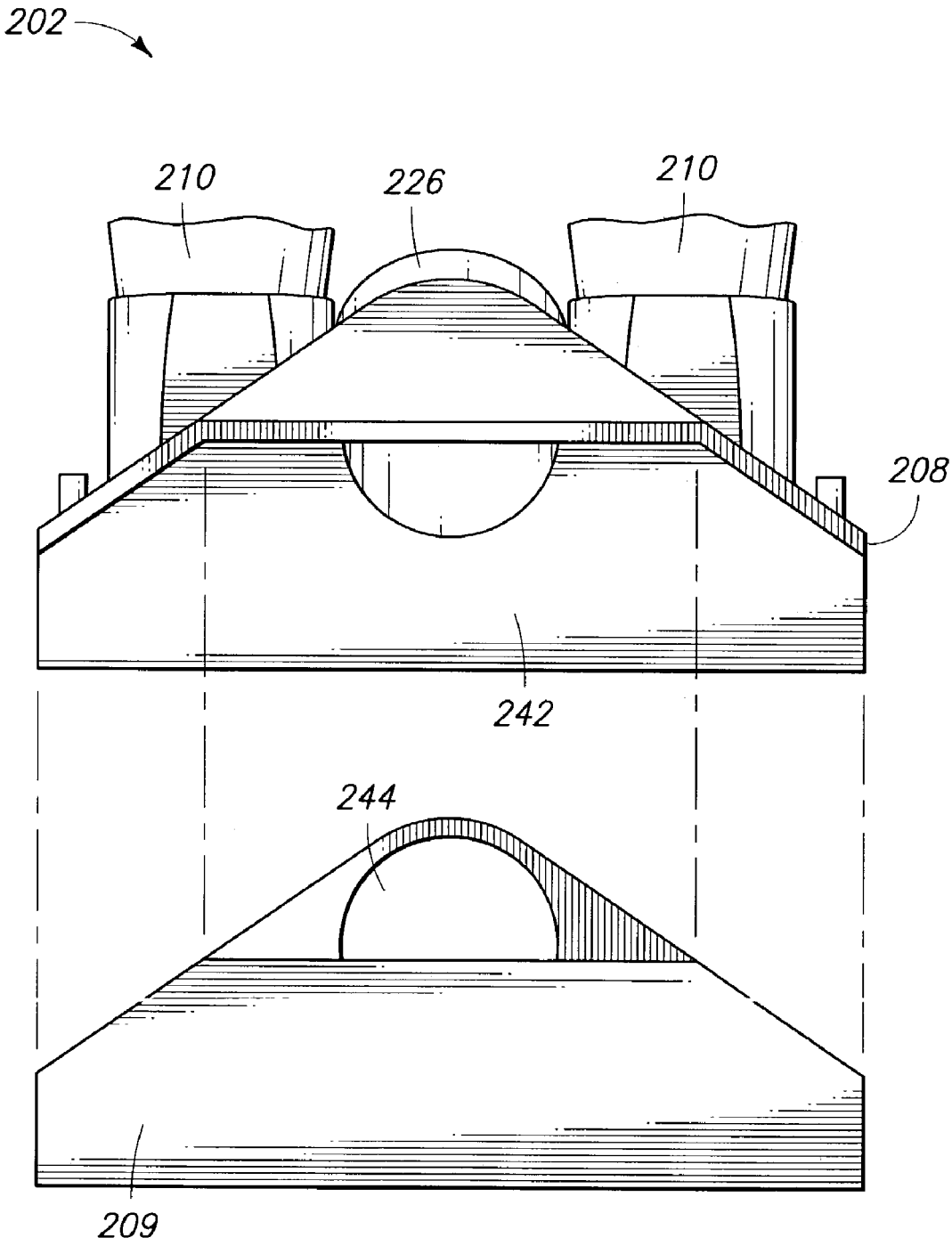

FIG. 16 is a front elevational view showing two portions of the second embodiment in exploded relationship.

Figure 17:
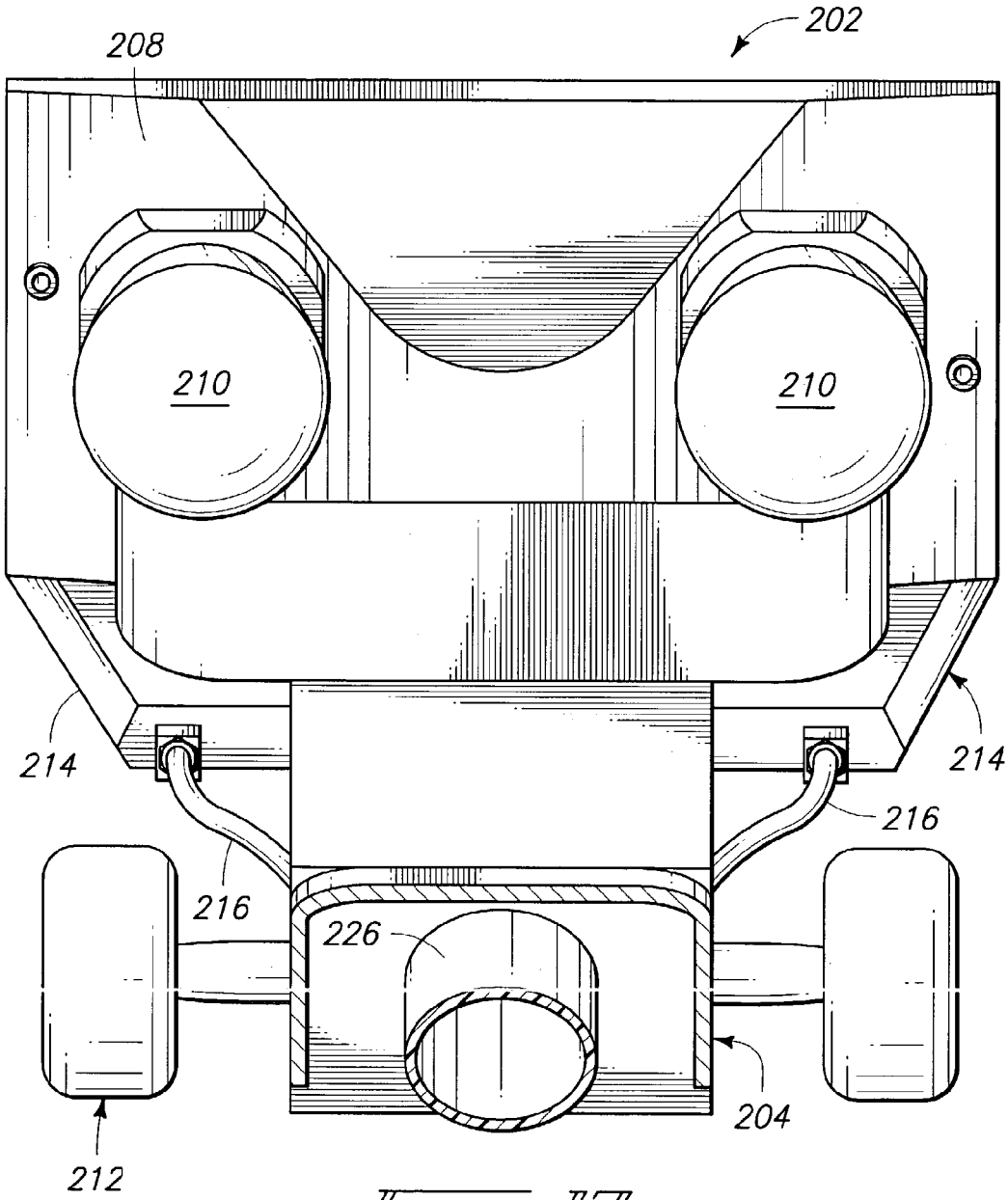

FIG. 17 is a top view of the second embodiment with upper portions of the portable unit removed and with portions shown in cross-section.

Figure 18B:
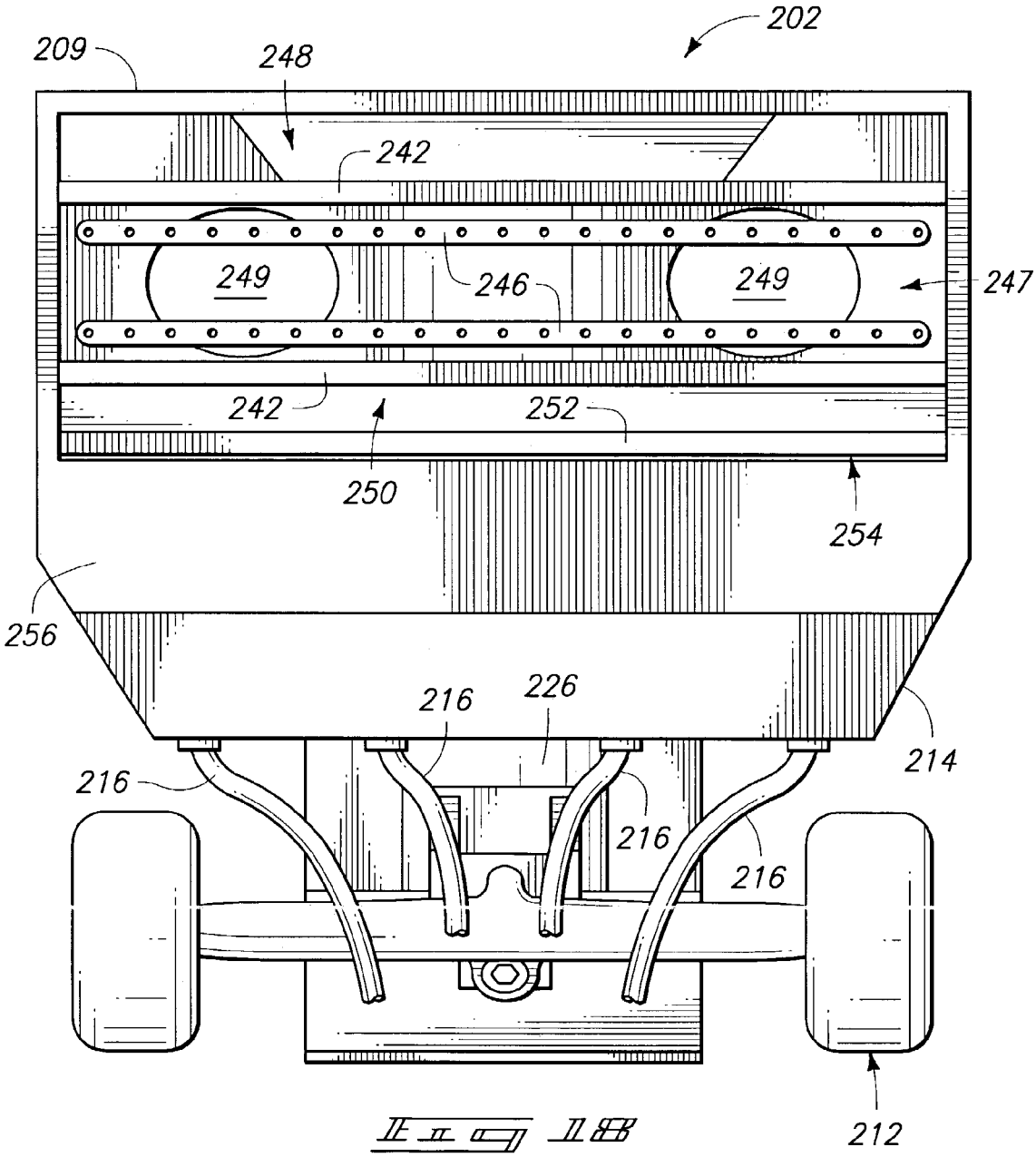

FIG. 18 is a bottom view of lower portions of the portable unit of FIG. 10.

Figure 19:
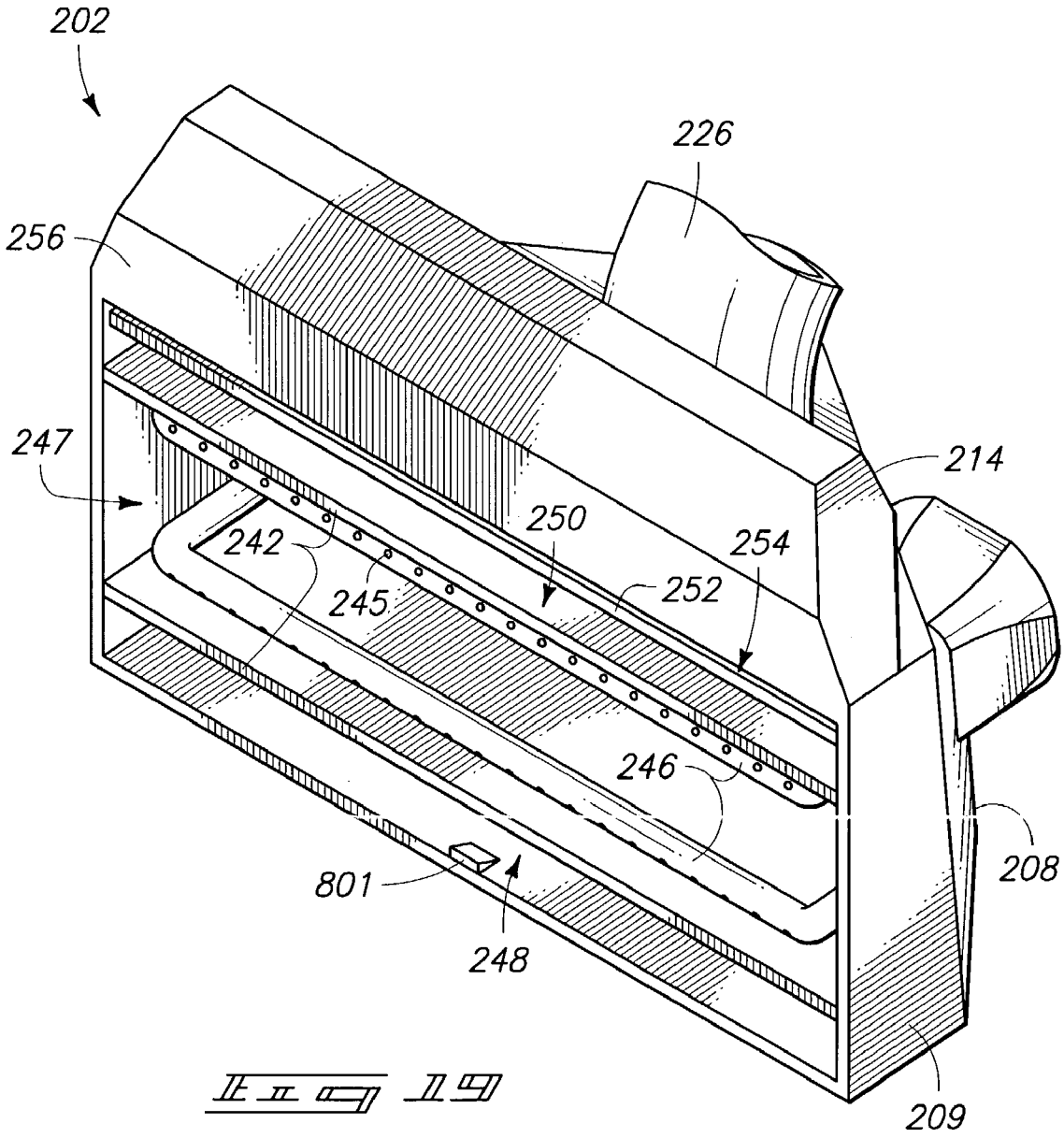

FIG. 19 is a perspective view looking into the bottom of the lower portions of the portable unit.

Figure 20:
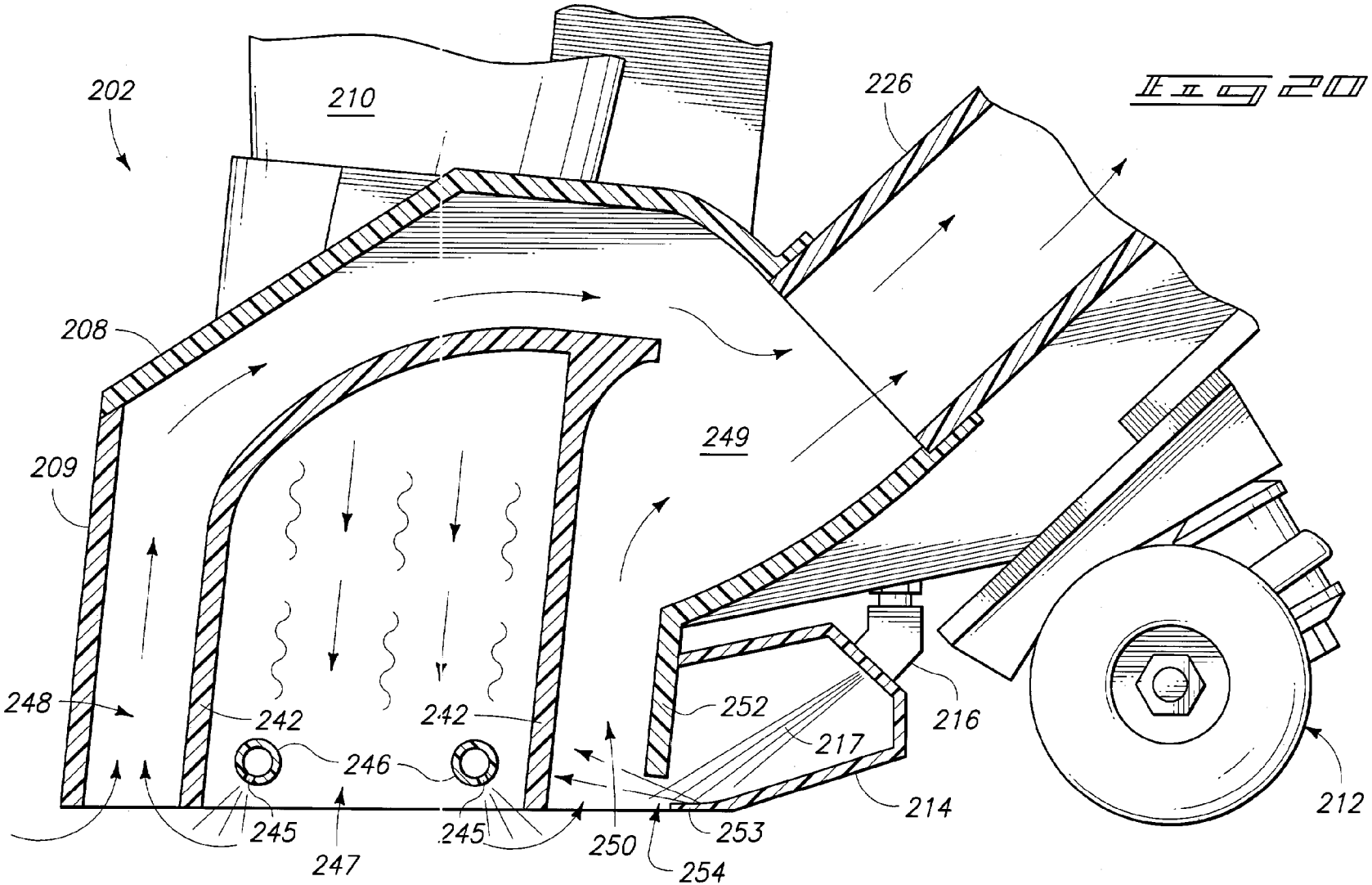
Figure 11:
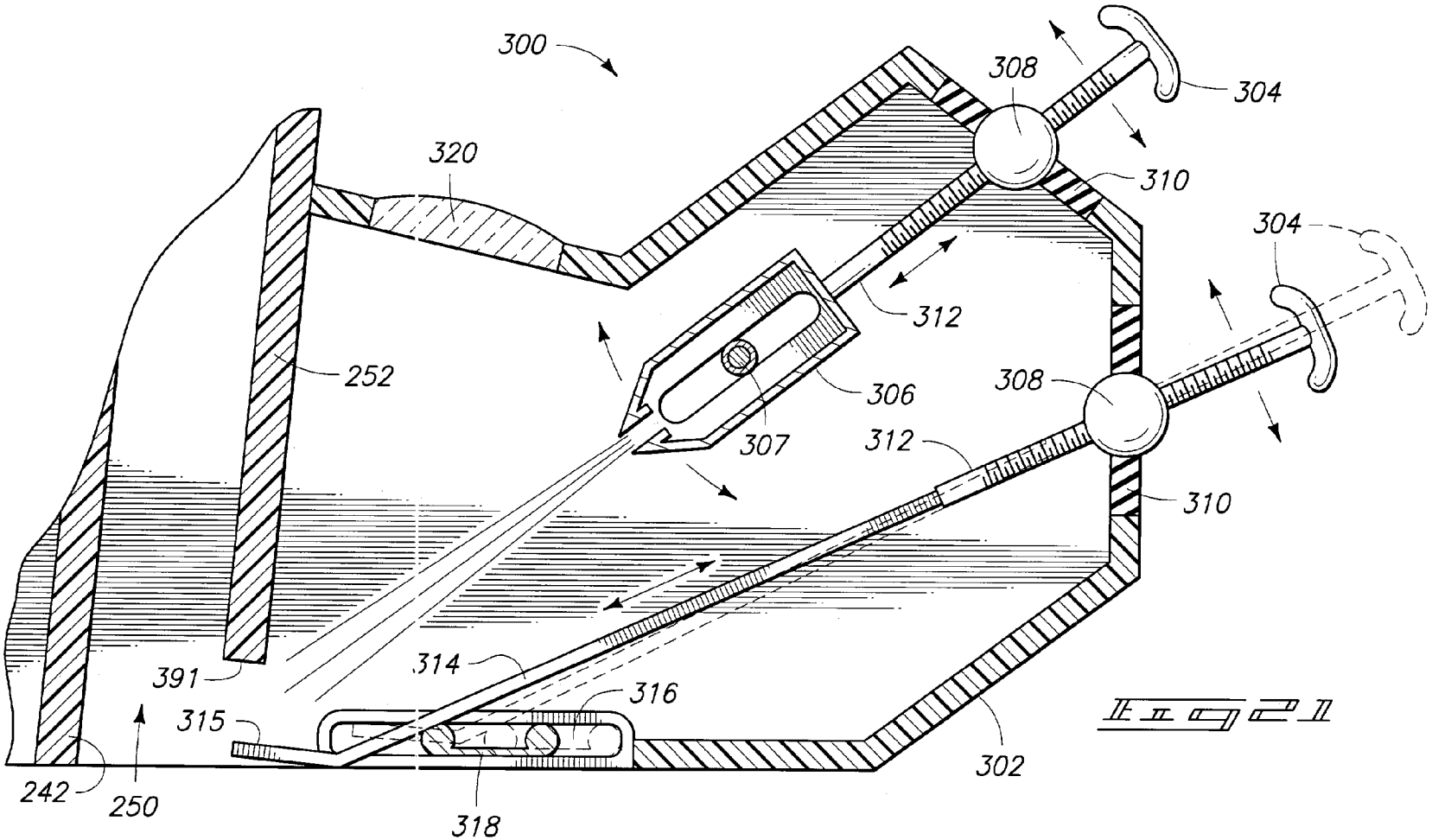

FIG. 20 is a side cross-sectional view showing lower portions of the portable unit and operational diagraming.

Third Embodiment

FIG. 21 is a sectional view showing portions of a portable unit according to a third embodiment of the invention, similar to the second embodiment except as shown in FIGS. 21–25.

Figure 22:
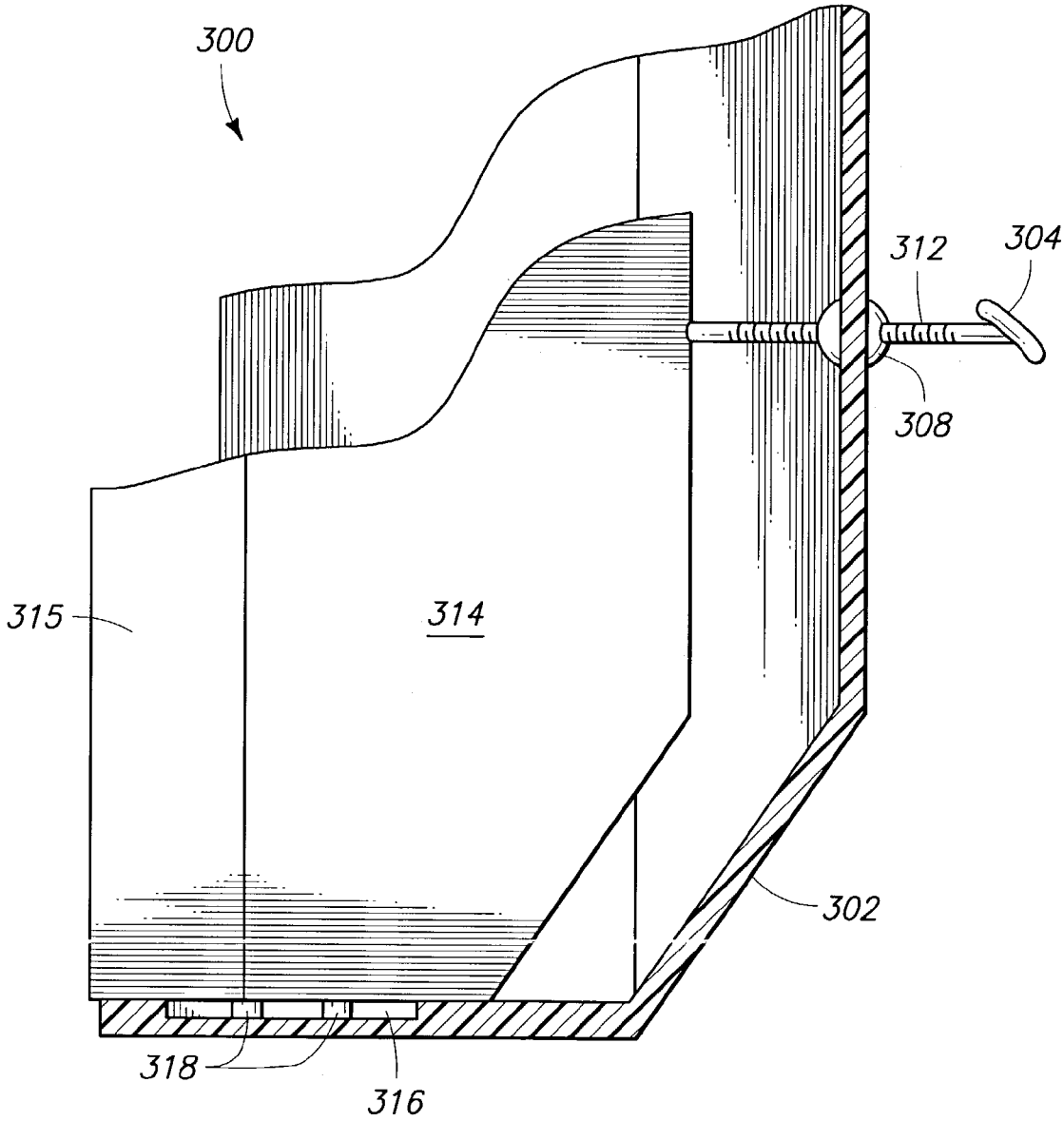

FIG. 22 is a top view partially in cross-section and enlarged to show a portion of the construction shown in FIG. 21.

Figure 23:
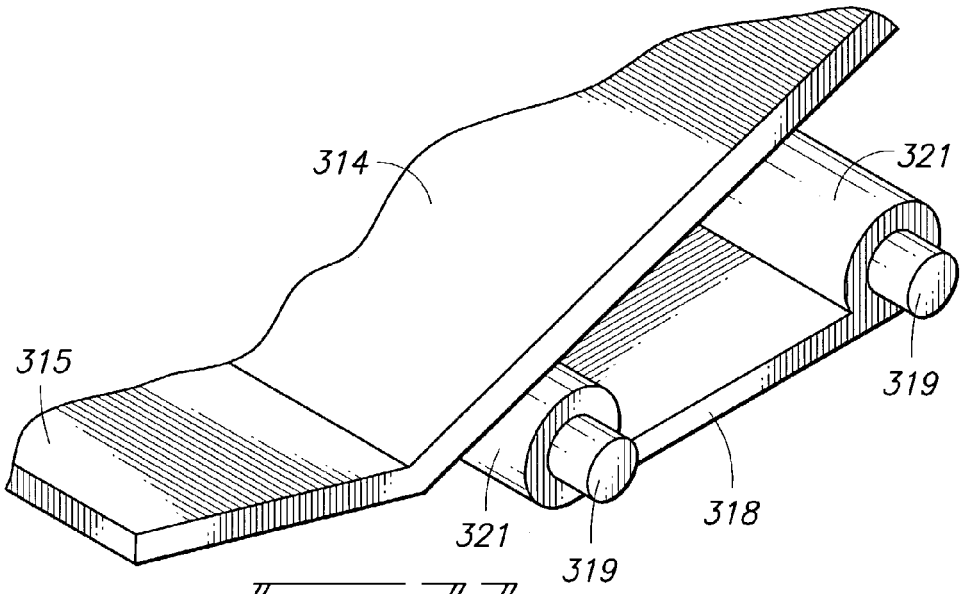

FIG. 23 is a perspective view showing some of the construction shown in FIG. 21.

Figure 24:
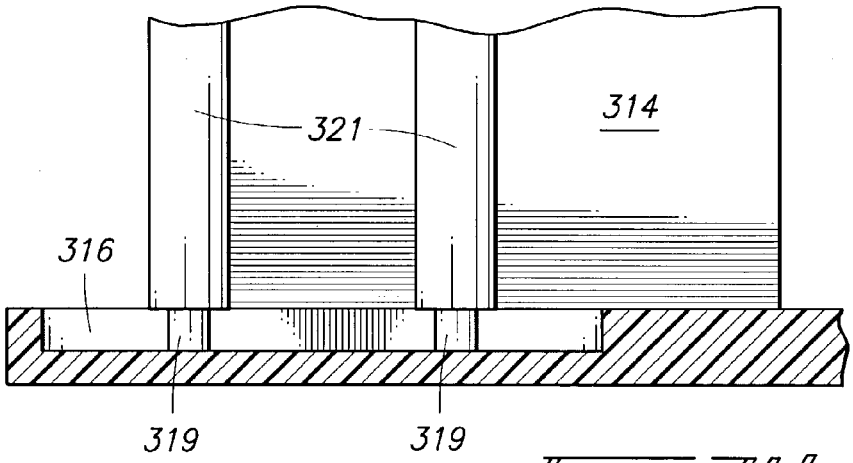

FIG. 24 is an enlarged top detail view partially in cross-section showing some of the construction shown in FIG. 21.

Figure 25:
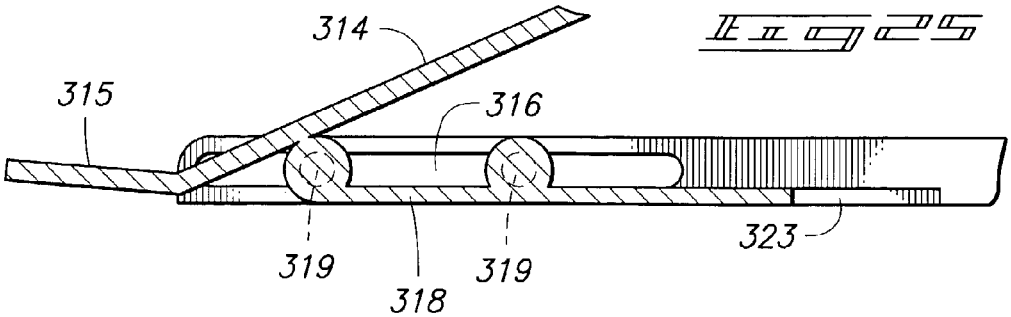

FIG. 25 is a side elevational view partially in cross-section showing some of the construction shown in FIG. 21.

Fourth Embodiment

Figure 26:
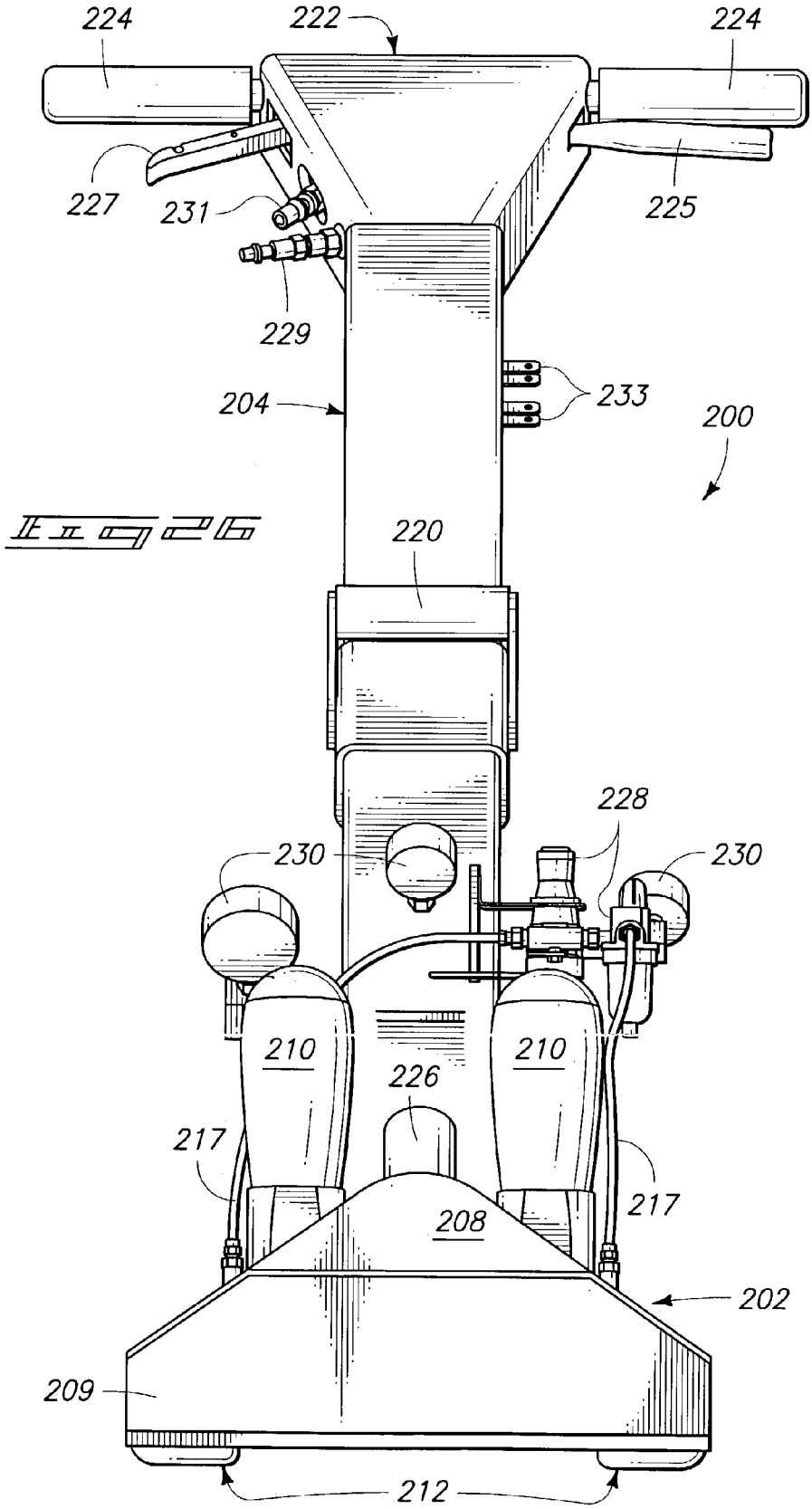
Figure 22:
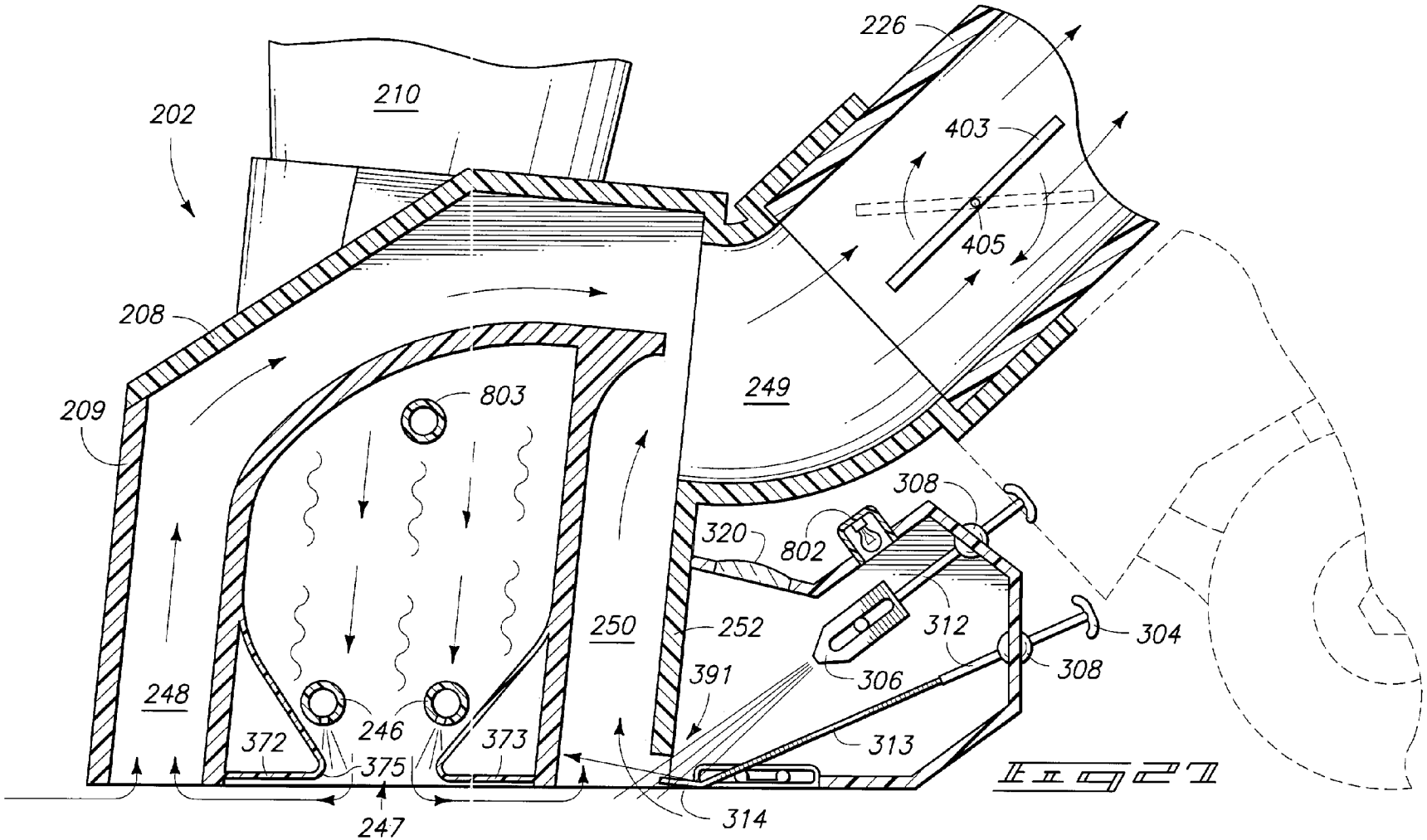

FIG. 26 is a front elevational view of a fourth embodiment according to the invention which is similar to the second embodiment with some modification.

FIG. 27 is a side sectional view showing modified features forming part of the fourth embodiment.

Fifth Embodiment

Figure 28:
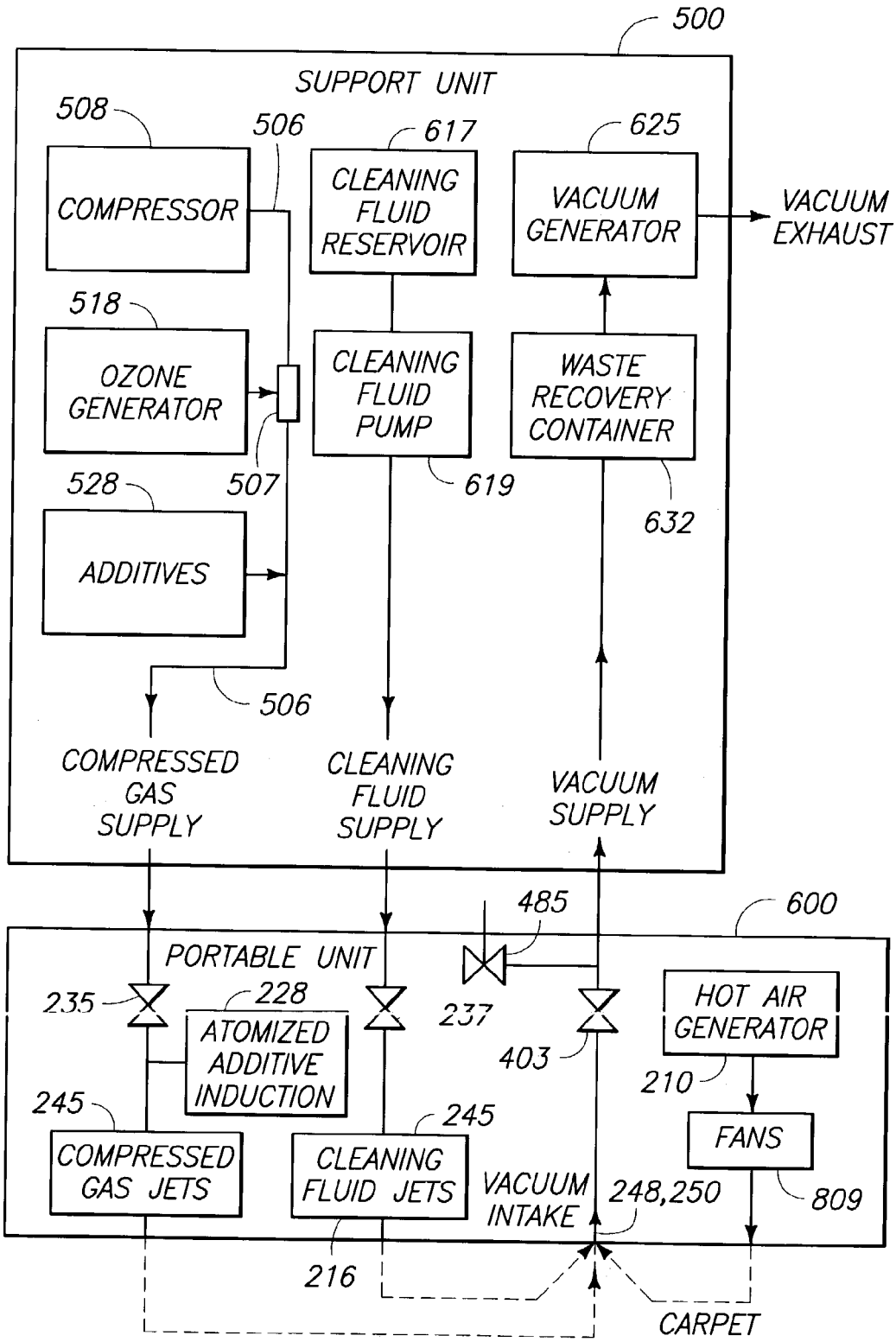

FIG. 28 is a schematic diagram showing an additional embodiment of system including a portable unit and a support unit which is remotely located from the portable unit during use.

DETAILED DESCRIPTION OF THE PREFERRED EMBODIMENTS

Introduction or Overview

One intent of the present invention is to provide a cleaning and drying system by which surfaces can be efficiently and well cleaned. The invention in particular is applicable to floors, even more significantly to carpeted floors and surfaces. The invention may also be useful in the cleaning of upholstery.

The invention utilizes a cleaning fluid which is applied to the carpet or other surface being cleaned. The cleaning fluid is preferably a liquid, such as a water or other appropriate solvent. The cleaning fluid can advantageously include a cleaning agent which is in mixture or solution with the cleaning fluid.

The preferred cleaning processes and equipment may also include applicators for applying deodorizers or fragrances or both to reduce odors and improve the smell of carpeting and upholstery being cleaned. The deodorizers and/or fragrances counteract odors which may be inherent in the carpet or which are picked up during use, for example, odors such as smoke or pet odors.

Another desirable aspect of the invention is the agitation achieved using a compressed gas or gases. Another preferred feature is to heat a drying gas which is applied to the area being cleaned, particularly carpet. The invention is of particular significance in cleaning carpets, drying carpets, and most preferably in both cleaning and drying carpets in a single operation.

The present invention also can include application of deodorizers, fragrances, conditioners, or other treatment additives. This can most it preferably be done via the compressed gas stream, or in other suitable ways.

Premise of Specification

Before considering the different embodiments described herein that each embodiment may be described using terminology which varies between different embodiments. However, the writing of this document was premised upon the ability of the writer to utilize terms which may be used in connection with one embodiment to also apply to other embodiments for the same or similar structures, functions, features and aspects of the concepts and technology being described. Accordingly, unless specifically indicated otherwise herein, terms from all embodiments are included in this description and are available for describing and defining the technology and exclusive rights being sought.

First Embodiment

The present invention is generally shown by the reference numeral 10 in the accompanying drawings. The intent of the present invention is to provide a cleaning and drying system by which floor surfaces can be efficiently and well cleaned, particularly carpeted floors. The invention is of particular significance in cleaning carpets, drying carpets, and preferably in both cleaning and drying carpets, particularly in a single operation. The problem of prior carpet cleaning systems in leaving a wet carpet is of particular concern.

System

In FIG. 1, a preferred form of the invention includes a cleaning head 12 in combination in a vacuum cleaning system 14. Here, the cleaning head 12 is shown connected to external pressure sources. In the illustrated example, a van or other appropriate carrier vehicle 16 is provided to house and transport a vacuum pump 18, an air pressure pump 20 and a fluid pump 22 for connection to the head 12. The vacuum pump serves as a vacuum source or supply. The air pressure pump or compressor serves as a pressurized gas source or supply. The fluid pump serves as a cleaning fluid source or supply. These may be conventional "off-the-shelf" commercial or industrial grade machines with capacities selected according to the work to be accomplished.

In the example illustrated, the components including vacuum pump 18, air pressure pump 20 and fluid pump 22 are selected for carpet cleaning purposes. To this end, the vacuum pump 18 is preferably a commercially available impeller driven vacuum, capable of developing an unloaded static lift of between 80 and 140 inches (water) at a minimum of 90 cubic feet per minute (cfm) in a conventional 2 inch vacuum hose line 25.

Pressurized Gas Supply

The air pressure pump 20 may be a conventional compressor with attached collector tanks capable of delivering air under pressure through a high pressure air hose 24 at between 40 and approximately 100 psi, adjustable according to the nature of the surface to be cleaned. It is preferred that the air pressure pump also be capable of delivering compressed injection air at the above pressure range with a flow rate up to approximately 12 cfm.

Cleaning Fluid Supply

The fluid pump 22 is preferred for carpet and other floor cleaning operations to be a high pressure washer, capable of delivering a cleaning fluid or water through a fluid pressure hose 26 at operating pressures of up to 1500 psi (preferably about 100 psi to 300 psi for carpet cleaning) at a selectable rate of between 0.5 and 2 gallons per minute (gpm). It is preferred that the fluid also be heated, to a temperature of approximately 200 degrees F. (° F.).

The rate of fluid application (up to approximately 2 gpm) is relatively high compared to conventional carpet cleaners. Such high fluid application rates are allowable with the present invention and are preferred for maximum cleaning efficiency. This is due to significant drying capability provided through directionally oriented application of hot air under pressure toward closely spaced vacuum components described above, and by further structure described below.

It is pointed out that the above components may be provided in combination with the cleaning head 12, or that the cleaning head may be manufactured and distributed separately, for use with various combinations of vacuums, air pressure pumps, and fluid pumps. Details of the cleaning head 12 will now be discussed.

Cleaning Head

A preferred form of the present cleaning head 12 is shown in detail by FIGS. 2–9 of the drawings. Cleaning head 12 has a main housing 30 which is preferably formed of a rigid material such as fabricated or cast aluminum, although other materials may be suitable for constructing the unit laving features shown herein or equivalent thereto.

Figure 6:
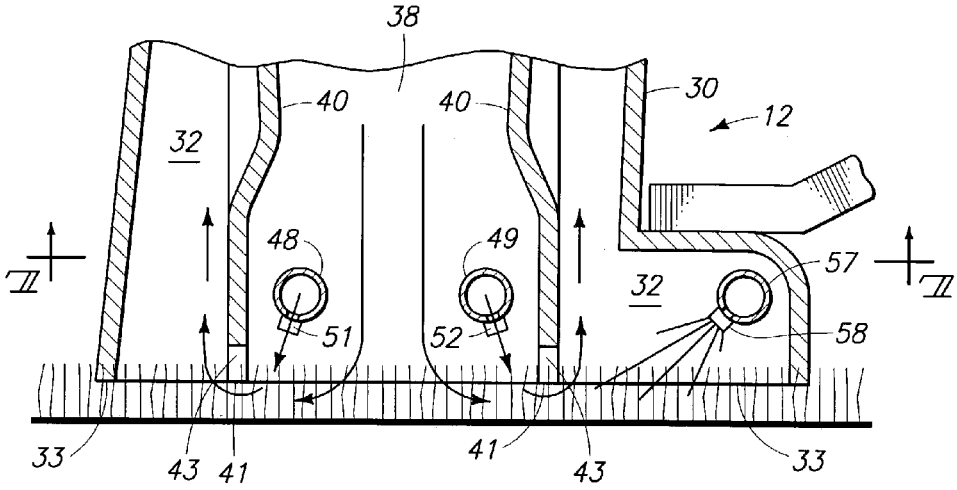
FIG. 6 is an enlarged operational view illustrating various fluid flow paths with directional arrows.
Figure 7:
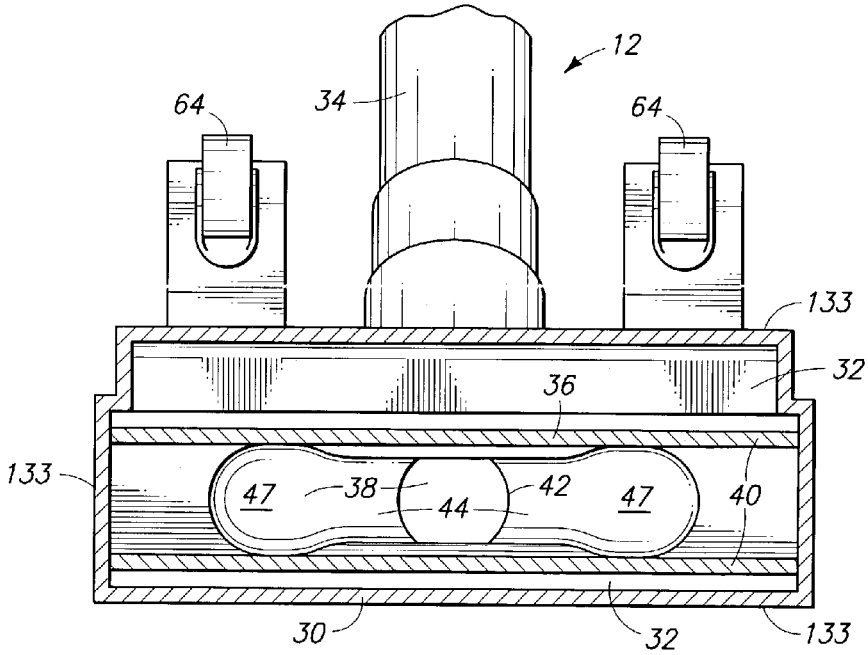
FIG. 7 is a sectional view taken substantially along line 7—7 in FIG. 6.
Figure 8B:
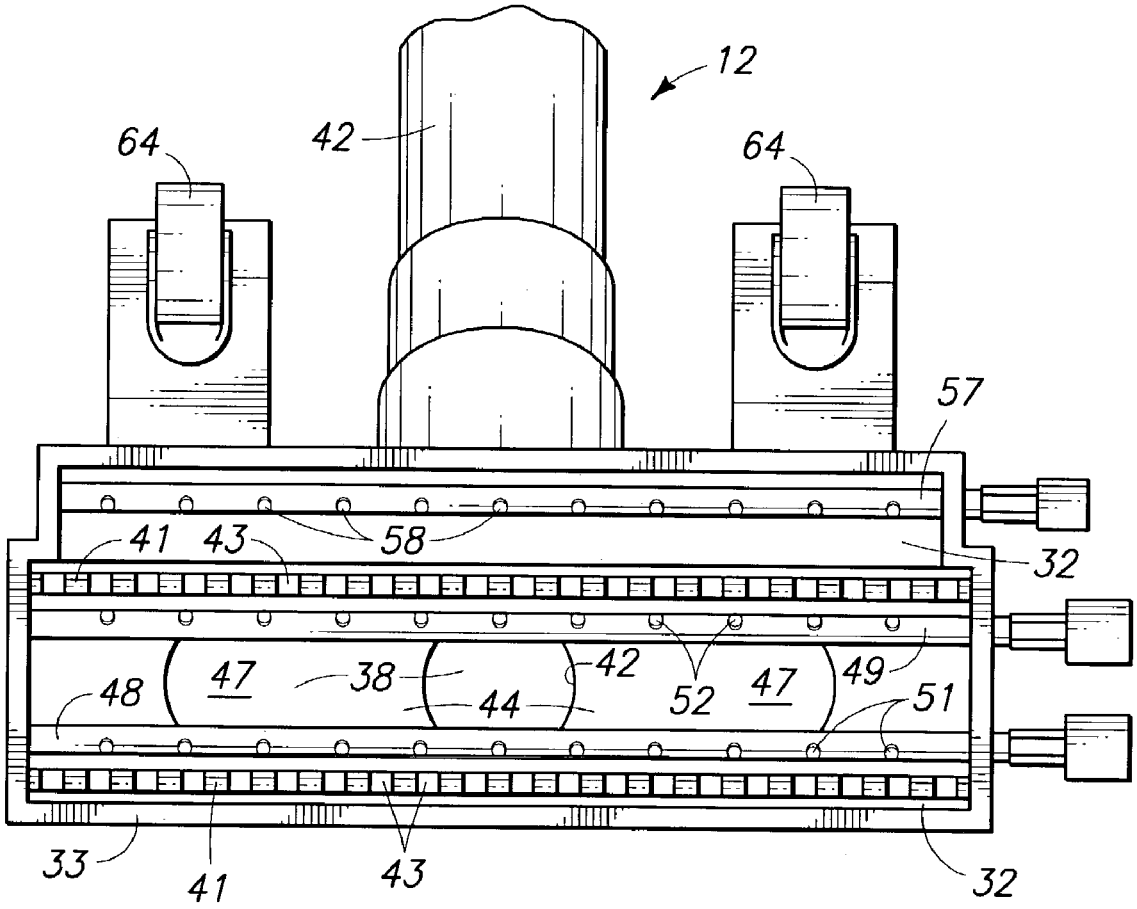
FIG. 8 is a bottom plan view of the preferred cleaning head.
Figure 9:
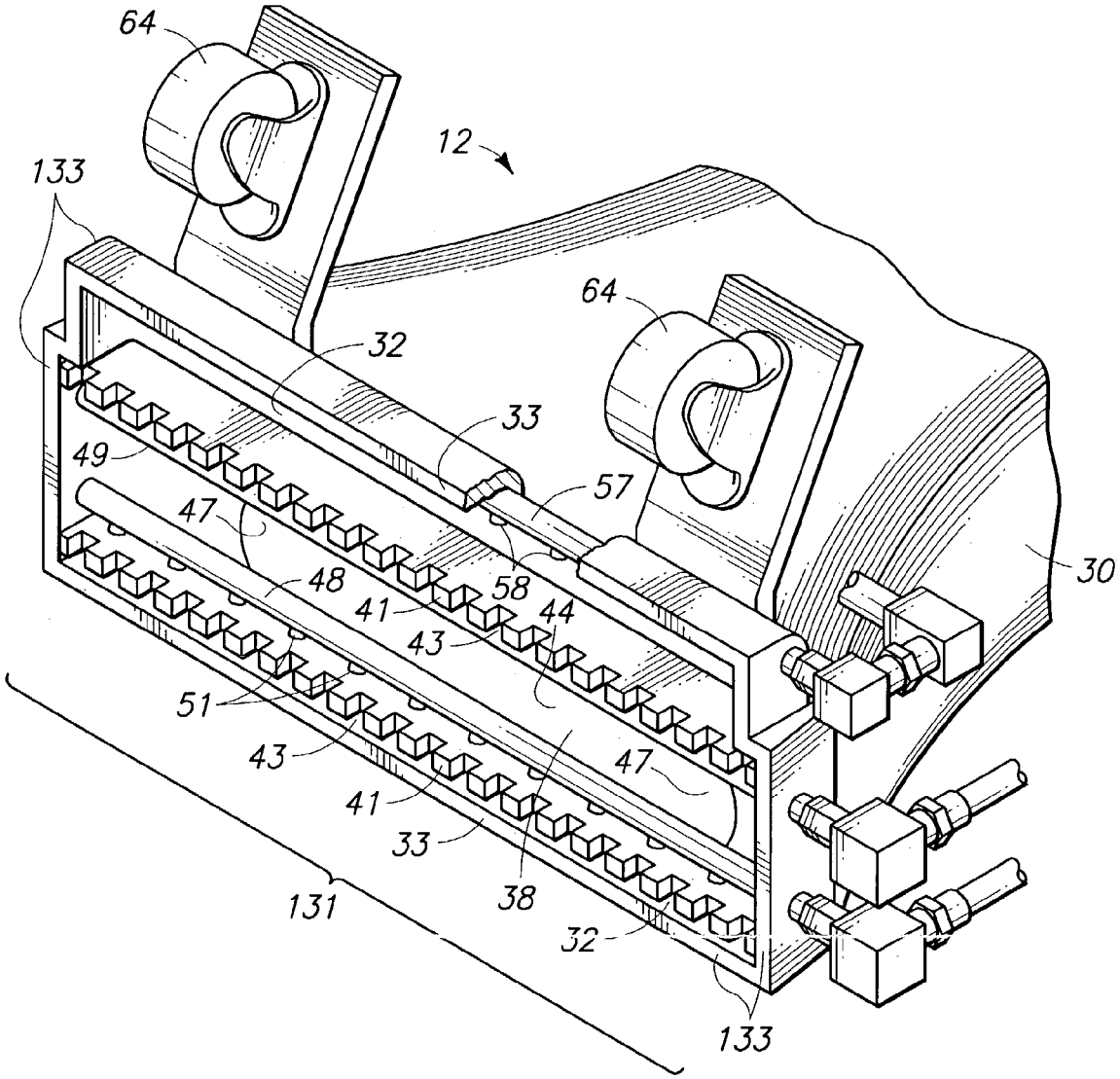
FIG. 9 is a fragmented perspective view of the cleaning head as viewed from below.

The cleaning head utilizes housing 30 to provide an operational face 131 which is best shown in FIGS. 7–9. This operational face is along an open bottom end of the housing. In operation the face is placed adjacent to and in juxtaposition with a carpet or other surface being cleaned (see FIG. 6). As shown, the cleaning head housing 30 has an outer or perimeter wall 133 which is about most or all of the operational face. The operational face is open along the bottom side of the housing to allow cleaning fluids, and drying and agitating gases to be applied to the surface being cleaned. The open operational face also allows debris, and the cleaning and drying fluids to be removed in a manner which cleans the carpet or other surface being cleaned. The operational face and other features of the invention also allow the carpet or other surface to be largely dried simultaneously with the cleaning procedure to significantly reduce or eliminate the drying time.

The outer or perimeter wall 133 serves to define or outline a working area therewithin which is across most or all of the open operational face. The outer wall 133 restricts air flow between ambient air which is outside of the outline of the perimeter wall and the working area which is within that outline. Although the bottom edge of the perimeter wall is preferably straight and even in the embodiment shown, alternative edge treatments may be satisfactory to allow the working area to be sufficiently restricted or confined when the face of the cleaning head is placed into an operational position against or facing the surface being cleaned.

When used on carpeted surfaces, the bottom edge of the outer housing wall forms a close or contacting relationship with the flexible carpet fibers and the possible flow of air between ambient areas and the working area is sufficiently restricted to allow the novel cleaning processes of this invention to be performed within the working area. Although this perimeter restriction does not need to be sealed against the floor or other surface, the outer wall is most preferably circuitous or approximately circuitous along a contact face which is adjacent to the carpet or other surface being cleaned to provide some restriction of air flow between the working area and the ambient air. The outer wall 133 also serves to help confine the working area within the outline of the outer wall so that desired flows within the working area are maintained as described more fully below.

The figures show that housing 30 can in a preferred form of the invention be formed as a hollow bell-shaped unit with an enclosed vacuum or intake plenum 32. In operation, the intake plenum is substantially confined except at the open operation face. The intake plenum defines at least one vacuum zone therewithin which is applied at the operational face to the surface being cleaned. The vacuum zone or zones are areas in which a significant vacuum pressure is developed across the face of the cleaning head so that debris and fluids are picked up and conveyed by the vacuum and associated outflow from the cleaning head.

The housing 30 serves to form and largely confine the uptake or intake plenum 32 within which vacuum pressures are developed. The intake plenum or passageway leads from the opening formed along the face of the cleaning head to a vacuum line or outflow connector 34. Connector 34 is adapted to mount an end of the vacuum hose line 25. In a preferred form, the connector 34 is extended to form or mount a handle for use by the operator as shown in FIG. 1.

Thus vacuum force produced by the vacuum pump 18 will induce air movement into and through the plenum 32 to the hose 25 and eventually to the vacuum pump 18. Arrows shown in FIG. 6 show this movement.

The cleaning head also includes one or more areas which are provided with drying gas. The drying gas areas are open along the operational face and are intended to provide a pressurized zone or zones which form part of the working area. The pressurized zone formed within the drying gas chamber or area is preferably provided using a hot air discharge housing 36. The hot air discharge housing 36 is advantageously situated within or at least partially within the hollow bell-shaped vacuum housing 30. Hot air discharge housing 36 is also bell-shaped and forms a hot air discharge plenum 38 that is enclosed on its sides by a partition wall or walls, such as zone partition walls 40. Zone partition walls 40 serve to form a restrictive partition between the pressure zone within discharge plenum 38 and the vacuum zones within intake plenum 32. The discharge plenum is advantageously within or partially within the intake plenum 32. The wall 40 (and plenum 38) leads from an open bottom end 41 to a hot air connector 42. The open bottom end 41 is substantially circumscribed (and preferably coplanar with) the open bottom end 33 of the hollow bell-shaped vacuum housing 30.

Figure 5:
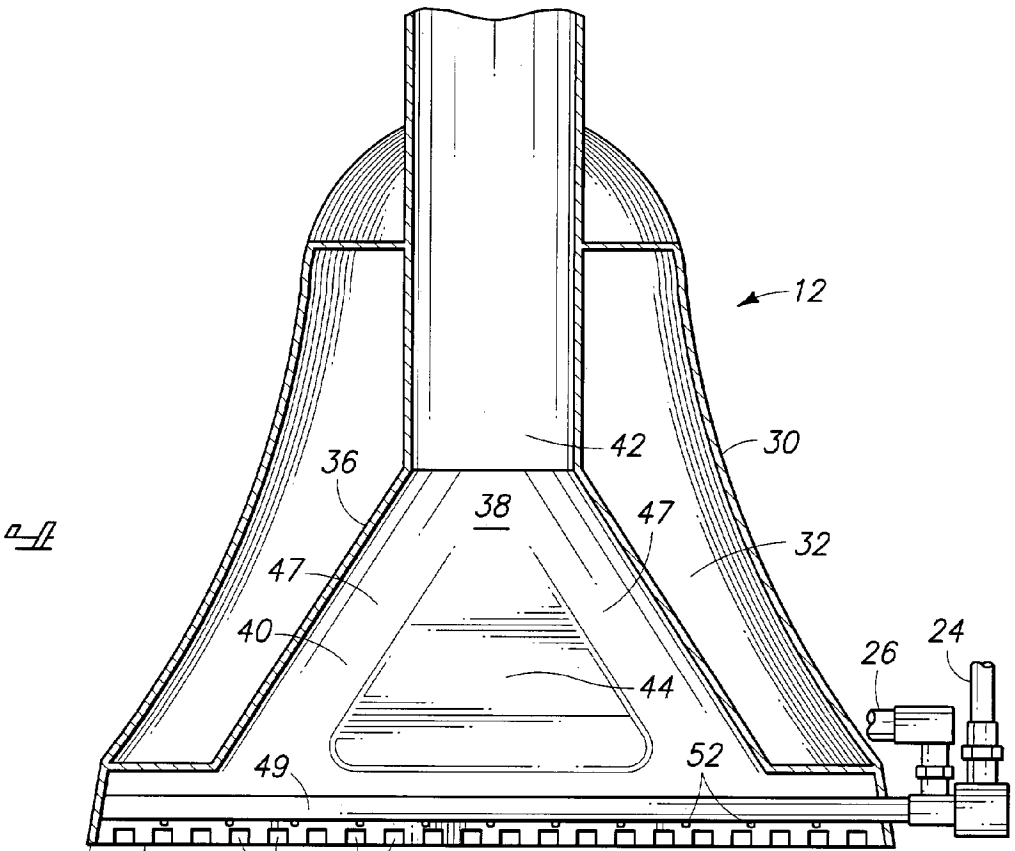
FIG. 5 is an enlarged cross-sectional view taken substantially alone line 5—5 in FIG. 3.
Figure 11:
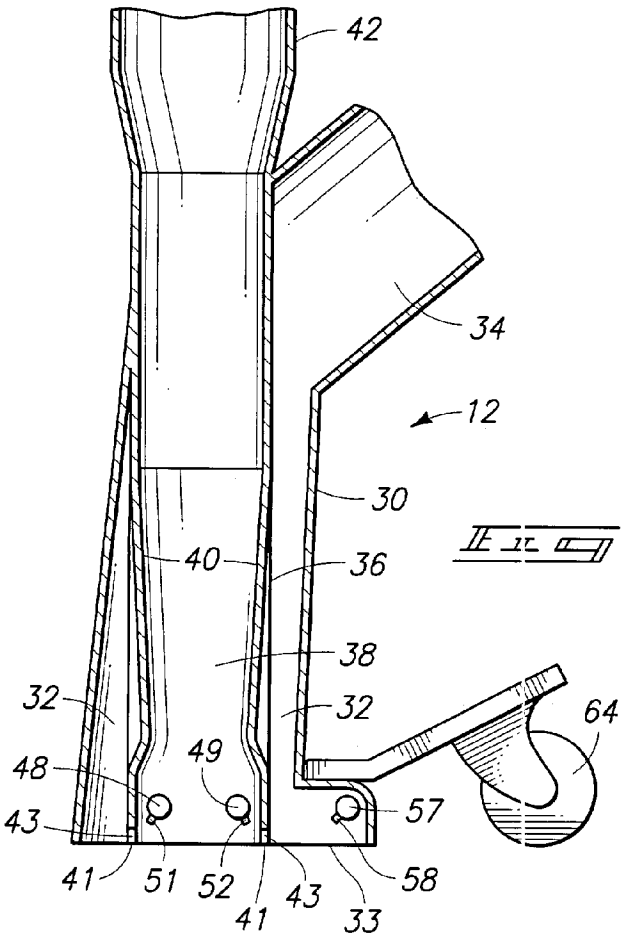

As shown in FIGS. 4 and 5, the preferred hot air housing 36 is integral with the bell-shaped vacuum housing 30. This may be done by conventional casting or welding methods. However it is also possible that the two housings be separate, then assembled in the manner described.

Hot Air or Drying Gas Supply

In preferred forms, a hot air blower 39 is mounted directly on the cleaning head. More specifically, the hot air blower 39 is mounted to the hot air housing 36 by way of the hot air connector 42. The hot air blower 39 is operable to direct a stream of heated air under positive pressure downwardly through the hot air discharge plenum 38. This heated air will impinge on the surface being cleaned (see arrows in FIG. 6), and be simultaneously drawn outwardly of the wall 40 at the open bottom end 41 and into the intake plenum 32 which surrounds the hot air housing. This air movement, from positive air pressure within the hot air discharge plenum to the negative pressure produced within the vacuum housing is an advantage in operation of the present cleaning head as will be better understood later in this description.

The desired amount of flow of hot air or other drying gas from the pressure or discharge plenum 38 into the uptake or vacuum plenum 32 occurs over the contact edge of the partition walls 40. This movement or flow of gas and debris is assisted by providing castellations or crenelations 43 (best viewed in FIG. 9). These features are formed along the partition walls 40 along the open bottom end 41 of the hot air housing 36. The castellations 43 minimize the possibility that a tight seal might develop between the bottom end 41 of wall 40 and the surface being cleaned, and thereby assure the desired degree of airflow for both cleaning and drying of the carpet or other surface.

Uniform hot air dispersion along the castellated wall edge is assisted by shaping the wall above the castellations substantially as shown in FIG. 7. A reduced cross-sectional area 44 is provided adjacent to the central part of the hot air discharge plenum. Enlarged open areas 47 adjoin the area 44, leading inwardly (FIG. 5) to the hot air connector tube 42. This configuration encourages the hot pressurized air delivered by the central hot air connector 42 to spread evenly through the plenum and to discharge evenly along the bottom end 40. It has been found that without the above plenum wall configuration, a column of hot pressurized air will be discharged in a concentrated central area directly below the connector tube 42 of the plenum with a resulting negative effect on cleaning and drying efficiency.

The hot air blower 39 is preferably comprised of an enclosed electric fan or blower 45 which is operable to produce an airflow across an electrical resistance heater 46. The hot air blower 39 may be of a conventional form, producing a discharged air temperature of at least approximately 200 degrees F. and an air movement of approximately 90 cfm. It is preferred that the hot air blower be adjustable to allow variance in temperature of the discharge air. Such adjustments are conventionally available and will enable the user to selectively adjust the temperature according to the surface to be cleaned and dried.

It is advantageous that the hot air blower 39 be mounted directly to the cleaning head 12. Air warmed by the blower will not have an opportunity to cool before impinging on the surface to be cleaned. Thus, the hot air blower need not be required to over-heat air to compensate for cooling along a long feed line. Also mounting the hot air blower 39 to the cleaning head 12 eliminates the need for another hose extending to the van.

Compressed Air Application

At least one and preferably two compressed air injection conduits or lines 48, 49 are positioned within the hot air housing 36. The lines 48 extend along the length of the hot air housing and include spaced compressed air discharge openings or nozzles 51, 52 respectively. The openings or nozzles 51, 52 are angularly oriented to discharge compressed air downwardly and angularly toward the intake plenum 32. The nozzles 51, 52 may be commercially available fan type nozzles which may be interchangeable with other nozzles of different outlet size or shape to vary airflow volume or pattern if desired.

The conduits or lines 48, 49 are connected, using common high pressure connectors to the pressure hose 24 which leads to the air pressure pump 20 in the carrier vehicle 16. An air drier and pressure regulator 54, and a pressure gauge 55 are preferably connected in the pressure hose 24 at the cleaning head to enable removal of water from the hose, and accurate adjustment of the air pressure. The hose 24 includes two head lines that extend between the regulator 54 and the lines 48, 49. A conventional hand-operated control 66 may be connected along the air pressure hose 24, preferably at the handle (FIG. 1) to allow the operator selective air control.

Cleaning Fluid Application

In a preferred form, the cleaning head 12 also includes a cleaning fluid or liquid discharge tube 57. The cleaning fluid discharge tube is arranged to discharge a suitable cleaning fluid or fluids within the working area and applied upon the surface being cleaned. As shown, the discharge tube 57 is positioned within the intake plenum 32 adjacent the bottom end 33. It alternatively could be located within the pressurized zone for discharge therein.

The fluid discharge 57 includes fluid discharge openings or nozzles 58. The nozzles 58 are preferably spaced along the fluid discharge tube 57 and are oriented to direct fluid downwardly and angularly toward the surface, such as toward the bottom end 41 of the hot air discharge plenum 38. The air discharge openings 52 of one compressed air injection line 49 and the fluid discharge openings 58 are advantageously angularly convergent, as shown in FIG. 4.

The angular orientation of the nozzles is such that cleaning fluid sprayed or otherwise discharged onto the surface being cleaned will be picked up by the air current running from the pressurized hot air discharge and be pulled into the vacuum pressures existing within the intake plenum 32. Thus a high flow rate can be used for greater cleaning efficiency without leaving an excessively wet surface.

It is also noted that the cleaning fluid nozzles need not be used. This may well be a preferred operation when it is desired simply to dry a wet surface area (such as a flooded carpet). Cleaning action will occur automatically as the high pressure and heated air flows cause turbulence and drying of the surface while the vacuum pulls moisture and loose debris from the surface adjacent to the working area.

The fluid discharge tube 57 connects to the fluid pressure hose 26 by way of conventional fittings, which also mount a water pressure gauge 60. A conventional manually operable valve 67 is connected along the fluid lose 26 at the handle to allow the user to vary or stop the flow rate of fluid through the nozzles 58.

It is also pointed out that the nozzles 58 may be removed and replaced with other nozzles of different opening size or spray patterns, depending upon the surface to be cleaned. For carpets, fan nozzles are preferred for saturation of the carpet fabric. Jet nozzles may be preferred for cleaning hard surfaces.

Methods, Operation and Manner of Use Preferred for First Embodiment

The invention also includes novel methods and such methods and related operation and use of the invention will now be given.

From the above description, operation of the present invention may now be easily understood. An exemplary operation will be described in connection with cleaning of a carpet. It should be noted however that the present invention may be used for cleaning, drying, or stripping other forms of surfaces. Operation of the present invention and its structure will remain substantially the same though scale may vary.

For operation of the present invention as a carpet cleaner, attention is in particular directed to FIGS. 1 and 6 of the drawings.

Prior to operation, the system is transported to the site to be cleaned and the various connections are made to set the system in order for operation. This may entail connection of the various elements requiring electrical power (such as the hot air blower 39) to a conventional source of electrical energy. Others of the units may be powered independently from within the carrier vehicle 16 by conventional power sources. The desired pressure and vacuum lines are also connected between the cleaning head and the respective pressure sources carried in the van. Pressure adjustments are made according to the work to be done.

For example, if the user is to clean a low shad carpet constructed of synthetic materials, the fluid discharge and compressed injection air pressures are adjusted accordingly. An operating pressure for the compressed injection air lines might be set at 60 psi., and temperature of the air from the hot air blower may also be adjusted to approximately 200°–250° F. Water flow (and any additives) might also be adjusted to 2 gpm at 200 psi. Adjustment of water flow is preferably completed after the vacuum, hot air blower, and the air pressure pump are activated.

Cleaning the carpet is accomplished in a manner similar to conventional carpet cleaning or vacuuming. As shown in FIG. 1, the cleaning head is simply moved back and forward on the carpet, covering all areas to be cleaned. To this end, rollers or wheels 64 may he provided on the back side of the cleaning head. The wheels allow the unit to be tipped rearwardly to engage the wheels with the support surface and allow the head to be moved to a desired location. Then, when in position, the unit may be tipped back upwardly (to the position shown in FIG. 1) so the bottom housing ends 33, 41 rest substantially flush on the carpet surface. Now the head can be pulled or pushed to perform the cleaning function. The controls 66, 67 at the handle may be selectively operated by the user to control air injection feed and water discharge as desired.

As the cleaning head is moved, several operations occur continuously.

Vacuum pressure produced by the vacuum pump 18 is continuously applied, drawing air, moisture and debris through the vacuum housing and into the vacuum hose to the external vacuum source where conventional filtering and collecting equipment collect the soiled materials. This cleaning action alone would ordinarily resemble operation of a conventional commercial or industrial vacuum cleaner. However, additional functions are also employed simultaneously with the vacuuming action to more thoroughly clean the carpet fibers.

The hot air blower will be functioning at this time to blow heated air against the carpet surface within the confines defined by the bottom end of the hot air plenum. The heated air impinges against the carpet, then is drawn through the castellations 43 and into the vacuum plenum.

The high volume of heated air causes increased evaporation and drying of the carpet fibers. This heated air movement is substantially supplemented by the jets of compressed injection air discharging from the high pressure air injection lines 48, 49. The pressurized air, discharging at 60 psi, and angularly oriented toward the castellated edges of the hot air plenum, will agitate the carpet fibers and carry the heated air through and under the castellations into the vacuum plenum. These two actions result in intermixed positive pressure air streams that will loosen and carry debris along toward the vacuum plenum, where the inwardly moving air current created by the vacuum pump will draw both streams and debris out through the vacuum hose.

The heated air applied under positive pressure moves downwardly through the carpet fibers toward a negative pressure in the vacuum plenum. This positive to negative transition produces a rush of air through the carpet that has a significant effect on cleaning and drying of the carpet fibers by agitating the fibers, passing relatively large volumes of drying gases therethrough, and by increasing the efficiency of the vacuum.

While the above airstreams operate, the fluid discharge may also be functioning (if desired) to produce a spray of fluid such as water (which may be mixed with detergents, etc.) against the carpet. The spray or other discharging flow of cleaning fluids is directed angularly toward the bottom end of the hot air discharge plenum. The spray also agitates the carpet fibers and the fluid itself will dissolve or loosen debris from the carpet. The water will be quickly picked up by the vacuum stream and what remains may be evaporated in the rush of heated air moving through the carpet fibers to the vacuum intake plenum. Thus the carpet is both cleaned and substantially dried both effectively and efficiently in the same operation.

As can be appreciated from the description given above, the invention also includes novel methods and processes for vacuum cleaning of surfaces, such as floors, and particularly carpets. In particular the invention is directed to the efficient combined cleaning and drying of carpeted floor surfaces. The cleaning of carpeted floors is a major commercial activity. It has in the past been plagued by the problem of the carpeted surfaces being left wet after the cleaning has been performed. It will also be appreciated by everyone that it is frequently very difficult to clean carpeted surfaces to the desired degree. This is typically true because the millions of thin fibers used to make up the carpeted surface are easy to pick up dirt and stains which are difficult to fully remove due to the large number of minute surfaces existing upon the carpet fibers.

Novel methods according to the invention preferably include forming a working area along a face of a cleaning head when the cleaning head is placed in an operational position facing a surface being cleaned. The working area is preferably at least partially enclosed or totally enclosed by an outer wall which restricts airflow between the ambient area and the working area which exists within the outline of the outer or perimeter wall. The working area preferably includes at least one pressure zone therewithin, and at least one vacuum zone therewithin.

The preferred methods also include providing a pressurized drying gas to at least one pressure zone. The pressurized drying gas is preferably heated. The heated condition of this gas serves to improve performance of the methods in several significant respects. Firstly, the heated drying gas increases the cleaning efficiency of the cleaning processes because the carpet or other surface being cleaned is better able to be freed of grease and oils at the higher temperatures. The higher temperatures also serve with the preferred application of heated cleaning fluids, such as hot water and detergent solutions, by keeping those solutions at a higher temperature while the cleaning fluids are in the carpet fibers. Thus is significant for improved cleaning, dislodgement of debris, and removal of stains such as notorious combinations of grease and dirt which resist cleaning. Heated gases are of significance in speeding the volatilization and drying of water and any other liquids which may be applied during cleaning. Also, when the system is used to remove floodwater or other liquid, the drying gas greatly speeds volatilization of these liquids from the carpet or other surface.

Methods according to this invention also preferably include jetting or otherwise discharging pressurized gas against the surface being cleaned. This is preferably accomplished from jets emitting within the working area, and more preferably within said at least one pressure zone. This discharging and jetting action is significant in speeding the drying rate. This is of particular significance with regard to methods for drying carpet, or both cleaning and drying carpet. The jetting action is also significant in agitating carpet fibers and other surfaces being cleaned to help by dislodging particles and liquids therefrom. The use of high pressure jets of drying and agitating gas further is important in providing relatively large volume flow rates which help to carry away the moisture which aids in the drying process.

The methods further preferably include passing the pressurized drying gas over at least one zone partition wall extending between the pressure zone or zones and the vacuum zone or zones. The preferred passing of the pressurized drying gas or gases causes the gases to move along the surface and this increases the potential for dislodgement of debris and liquids, and also speeds drying. This step can be effected by passing the pressurized gas over a zone partition wall which is intermittently open, such as at the crenelations discussed above. This facilitates continued but controlled air flow rates even though the cleaning head may be in close proximity and flow of air between the pressure and vacuum zones would otherwise be too restricted.

Methods according to the invention can further include discharging a cleaning fluid, such as chemicals, water and detergent, or others within the working area. This leads to applying the cleaning fluids to the surface being cleaned because the fluids are released into the working area and are communicated to the surface by the turbulence of the rushing gases, or by directly spraying the cleaning fluids upon the surface.

Methods according to the invention further include evacuating or withdrawing gases and debris from the vacuum zone or zones. The evacuating is effective at removing pressurized gases supplied to the pressure zones to remove the drying gas, debris and any other fluids from the at least one vacuum zone and adjacent surface being cleaned. The removed gases, fluids and debris can then be suitably contained and disposed of as the situation warrants. In the typical carpet cleaning situation contemplated herein, the gases can be released and the liquid and debris is contained within a soiled water container and properly handled for ultimate disposal.

The description given in this section is also supplemented by the operation, use and methods described elsewhere herein.

Second Embodiment

FIG. 10 shows a portable unit 200 according to a second preferred version of the invention. The portable unit is used by moving it into a room where the carpet or other floor surface is to be cleaned. The portable unit 200 can be used with a support unit, such as the vehicle mounted support unit shown and described above, or it can be used with other alternative support units, such as described further hereinafter.

Portable Unit Generally

Portable unit 200 generally includes a framework 201, an operator interface 222, and a cleaning head 202. The human operator controls the unit using the operator interface 222 by directing the cleaning lead 202 to move into desired locations. The operator interface also allows operational control over the fluid flows and other operational parameters.

Portable Unit Framework

The portable unit framework 201 includes a main part 204 which extends longitudinally between the operator interface and the cleaning head 202. In the preferred form shown, the main part 204 is a U-shaped elongated member which is closed upon the front and sides and open along the back side. This allows fluid conduits to be installed into the main part and provide maintenance access.

Framework 201 may also include an optional handle 220. Handle 220 is preferably mounted upon a detachable handle subframe 250 which is connected to the frame main part 201 using fasteners 251. The handle includes handle brackets 221 which are welded or otherwise affixed to the handle subframe.

Carrier handle 220 is preferably provided with a cylindrical handle bar 222 which is advantageously covered with a cushion grip made from an open cell foam elastomer to improve handling comfort and reduce operator fatigue. The porting handle bar is secured to the handle brackets in a suitable manner such as by using the fasteners shown.

The handle subframe 250 can also advantageously be used to provide a stand 260 which maintains the unit in a desired attitude when the operator stops and wants to turn lose. Stand 260 includes a pair of stand mounting brackets 261 which are welded or otherwise attached to the handle subframe or other parts of the framework.

The stand also includes a stand strut assembly 206 winch can be provided in a variety of shapes and constructions. The stand strut assembly 206 is pivotally mounted to the mounting brackets 261 using a pivot fastener 265.

During use of the portable unit, the strut assembly 206 is pivoted toward the main frame part 201 and out of the operator's way. This is further advantageously facilitated by return springs 241 (FIG. 13) which bias the strut assembly into the closed position against main frame part 201. When the stand is being used to support the portable unit, it is positioned as shown in FIG. 10. The stand strut is also preferably provided with rubber or other soft, resilient feet 263 to reduce marring and damage to the supporting floor or other surface.

The main frame part 201 also preferably mounts electrical connectors 233. These are preferably male connectors which can be inserted into the female ends of one or two extension cords. This allows the extension cords to be connected at their opposite male ends to electrical receptacles. There are two male electrical connectors to allow current from two different circuits to be used if needed or desired. Each electrical connector is advantageously attached to electrical circuit breakers 234 to add operator protection from electrical shock.

Portable Unit Carriage

The framework is preferable connected to a rolling carriage 212 which allows easier movement of the portable unit from one location to another. The rolling carriage also allows the unit to be easily operated by rolling it upon a carpet or other surface. It further allows the portable unit to be tipped backward and forward to lift or contact the working face of the cleaning head.

The rolling carriage 212 is in one preferred form of the invention provided by a wheel set commonly used for skateboards. These wheel sets allow some flexibility to angle the wheels and provide limited turning ability. Other rolling carriage constructions may alternatively be used.

Portable Unit Operator Interface

FIG. 12 shows that in the preferred construction shown, the operator interface 222 includes two main handle bars 224. Main handle bars 224 extend laterally outward from the longitudinal axis of the main frame part 201. Handel bars 224 allow an operator to control direction and movement of the portable unit during operation. Handle bars 224 are also advantageously provided with resilient covers as explained with regard to handle bar 220 above.

The operator interface also preferably includes a compressed gas control 225 and a cleaning fluid control 227. Compressed gas control 225 is pivotally mounted to the operator interface frame at pivot 228. A compressed gas control valve 235 has an activation pin 236 which is controllably moved by the control handle to control the supply of compressed gas to the cleaning head via hose or other conduit 240. A quick connection gas coupling 229 allows gas supply hoses (not illustrated) to be connected and disconnected with the portable unit from the support unit.

Cleaning fluid control 227 is advantageously a fluid control valve having a pivoting operating lever incorporated into the valve body. A quick connection fluid coupling 231 allows cleaning fluid supply hoses from the support unit (not illustrated in FIG. 13) to be connected and disconnected thereto. The cleaning fluid stream controlled by valve 237 emits through cleaning fluid hose 239 or other suitable conduit for controlled flow to the cleaning head 202.

Portable Unit Cleaning Head

The cleaning head forming part of the portable unit has a number of features and functions. FIG. 19 shows the bottom operational or contact face of the cleaning head. FIG. 20 shows the construction in sectional view. The cleaning head applies vacuum to the carpet or other surface being cleaned. This is advantageously done in adjacent relationship to a supply of heated drying gas, such as air. The vacuum withdraws heated drying gas after it has contacted the carpet and evaporated moisture into a vapor state. This results in drying of the carpet.

The cleaning head also preferably applies cleaning fluids to the carpet or other surface being cleaned as is explained in greater detail below. The cleaning fluids can be sprayed, jetted or otherwise applied onto the carpet fibers to help dislodge or dissolve dirt and oils. As explained further below, this is preferably done in a manner which directs the cleaning fluid along the length of the carpet fibers. This is most preferably done from the base of the fibers toward the distal ends of the fibers to provide increased effectiveness in dislodging dirt, oil and other debris materials from the carpet.

The cleaning head further advantageously utilizes a compressed gas to agitate the carpet to facilitate cleaning and/or evaporation and drying of cleaning fluids from the carpet. The compressed gas can also advantageously be used to apply certain treatment chemicals to the carpet or other surface being treated. For example, the compressed air or other gas can be used to carry deodorants, fragrances, conditioners and other suitable treatment materials. This is preferably done by atomizing the treatment chemicals so that they are carried in very small particles, such as droplets or vaporous form, for better penetration into the carpet. This is also preferably done using a relatively volatile carrier, such as ethanol, which aids carpet and fiber penetration while additionally performing a biocidal action on microbes and/or very small organisms which may be present in the carpet.

Cleaning Head Vacuum

The cleaning head includes a vacuum space portion which is subjected to vacuum pressures generated by a vacuum generator which is not shown in FIGS. 19 or 20. The vacuum is applied to the vacuum space via vacuum tube or supply conduit 226. Vacuum tube 226 extends upwardly within the main frame piece and has a vacuum hose coupling (not illustrated) which is connectable to or detachable from a vacuum supply hose run from the vehicle or other support unit.

The preferred cleaning head 202 has vacuum chambers 248 and 250 which are on opposing front and back sides of the central chamber 247. Heated air or other drying gas is supplied via central chamber 247. The adjacent vacuum chambers 248 and 250 provide vacuum areas on the operational face of the cleaning head which facilitates pick up of any materials. This is true whether the portable unit is being is moved forwardly or rearwardly.

Cleaning Head Drying Gas

The drying gas chamber 247 is preferably provided with heated air or other suitable drying gas or gases. This is most advantageously done using one or more heaters 210. Heaters 210 preferably include electrical resistance heating coils which are energized to heat the air or other gas drawn over the heating coils. The heaters 210 have upper or distal ends which have mesh or screen intake covers 211 (FIG. 12).

The cleaning head drying gas is also preferably forced into the drying gas plenum or chamber 247. The drying air or gas is forced against the carpet or surface being cleaned. As shown, this is accomplished using fans 809 (not shown in FIG. 20, see FIG. 28) which are mounted within the heaters 210 with the outflow from the heaters directed downwardly and into the drying gas chamber 247.

It has further been learned by the inventor that by pressurizing the heated drying gas to a small degree, drying of carpet fibers can be improved. This apparently results from the push and infiltration of the hot drying air or other gas into the carpet between the carpet fibers and into the carpet backing.

The drying gas in the drying gas clamber is advantageously over 200° F. and less than 400° F., when the surface being cleaned is carpet fibers. More preferably the temperatures of the drying gas are in the approximate range from about 250° F. to about 350° F.

Cleaning Head Compressed Gas

The controlled flow of compressed gas from control valve 235 through compressed gas line 240 is supplied to suitable compressed gas applicators. The compressed gas applicators are preferably in a form such as gas application manifolds 246. The gas application manifolds have a series of application nozzles winch, as shown, are small holes formed in the tube 246.

The cleaning head compressed gas applicators are preferably used for the purpose of directing jets of compressed gas at the carpet or other surface to help dislodge dirt and other materials. Such gas application is also used to agitate carpet fibers and moisture on the carpet surfaces being cleaned. This aids in vaporization, such as to vaporize water or other fluids, for example cleaning fluids and flood water.

It has also been discovered that the compressed gas flow can advantageously be used to apply treatment chemicals, such as in the manner described in more detail below. The treatment chemicals are introduced as additives to the compressed gas flow.

Applied Treatment Chemicals or Additives

The compressed gas applicators or other applicators mounted in the cleaning head 202 can be used to apply treatment chemicals or similar materials to the carpet. For example, fluids of various types can be applied by jetting them on or toward the carpet, such as from manifolds 246 or other distributors mounted in the cleaning head.

Examples of additives include ethanol, ozone gas, aromatic oils, aromatic oils and mixtures of solvents and chemicals similar to fabric softeners to soften and condition to render carpet fibers more pleasant or flexible. The additives can also be used for neutralizing pet and smoking odors. This additive treatment provide fresh smelling fragrances to the carpet, and inhibit or kill molds, mildew, mites and other small organisms or microorganisms.

Compressed Gas Subsystem Used to Apply Additives

Suitable additives are preferably entrained into the compressed gas before the compressed gas is jetted at or otherwise applied to the carpet. The additives may be entrained or otherwise added into the compressed gas either in the portable unit or in the support unit.

In one version of the invention, the additive is ozone gas and it is generated and entrained into the compressed gas in the support unit. This is so configured to allow the ozone generator to utilize the engine, other prime mover or power device used to power the support unit.

FIG. 28 shows in schematic presentation a support unit 500 having a compressor 508 which supplies a suitable compressed gas, in particular compressed air. An ozone generator 518 is used to generate ozone gas. The ozone generator can be chosen from a number of suitable ozone generators previously known or hereafter developed. The ozone can be entrained into the compressor outflow conduit 506 using a venturi 507, compressor (not shown) or other suitable manner for combining the gaseous additive into the compressed gas stream.

FIG. 28 also shows that other additives, such as explained herein, can also be supplied from additive supply unit 528 and entrained into the compressed gas line 506, using a venturi or other induction device now known or hereafter developed. Alternatively, the additives can he injected, pumped, compressed or otherwise caused to flow into the compressed gas line 506.

Atomized Additive Induction

FIG. 28 also shows an atomized additive induction unit 621 which can be used additionally or in lieu of the other forms of entraining additives into the compressed gas supply. One preferred and suitable form of device for providing atomized additive induction is to use relatively commonly available "oilers". These oilers are used to atomize and distribute lubricating oils and are well-known in the act of lubrication technology. Such oilers have a reservoir and a venturi or other branch inflow inducer. FIGS. 12 and 26 show oilers 228 which are connected to compressed gas supply line 240. The oilers hold additives, such as liquid additives. The rush of compressed air or other gases through the oilers causes induction of the additives into the compressed gas flow. This can be done with a venturi or other suitable means for mixing the additive into the compressed gas. The additive is most preferably atomized by the additive inclusion device used.

The compressed gas fed in conjunction with the additive infusing oilers or other similar infusing device are supplied to the compressed gas manifolds 246 via compressed gas feed lines 217.

Cleaning Fluid Application

The cleaning fluids and any cleaning additives entrained therewith are preferably applied using one or more cleaning fluid jets. The cleaning fluid jets are emitted in a suitable manner, such as from cleaning fluid nozzles 245 supplied with fluid from a cleaning fluid manifold 246 used when multiple jets are desired. In general multiple jets are desired to provide more even cleaning fluid application across the working or operational face of the cleaning head.

Cleaning Fluid Application using Directional Guides

FIG. 20 shows a preferred form of cleaning fluid applicator generally referred to as applicator 214. Applicator 214 has a containment or chamber wall which can be shaped and sized as necessary or desired for the particular machine being built. One or more cleaning fluid application nozzles 216 are mounted in the upper back corner of the applicator chamber and are used to emit a series of cleaning fluid application jets or streams 217.

The cleaning fluid jet streams 217 are oriented to impinge upon a strike pan 253 which is integrally formed with the applicator housing. As shown the strike pan is a ledge which extends across the machine. The jets 217 are aimed so that all or a portion of each jet impinges on the strike pan and is reflected and scattered. This changes the orientation of some portion of the stream redirecting into a fan or spray which is more generally horizontal. This generally horizontal orientation of the stream causes the cleaning fluid to travel along the axis of the carpet fibers. This occurs in part because the underside of the strike pan 253 lays the carpet fibers over into an approximately horizontal position. The cleaning fluid is preferably directed from the base of the fibers toward the distal ends when the machine is moved in operation.

It is also noteworthy that the reflected cleaning fluid jets also have an upward component of movement which helps to lift dirt and oil from the carpet. This further aids in the cleaning process.

Vacuum Pickup Subsystem

FIG. 20 further shows that the vacuum conduit 226 is connected to the cleaning head 202 and applies a vacuum pressure via a vacuum plenum 249. The vacuum clamber includes plenum 249 and front and rear vacuum passages 248 and 250. Vacuum passages 248 and 250 are along the front and rear of the machine and form additional parts of the vacuum space confined by the vacuum clamber vessel walls. The vacuum passages 248 and 250 have vacuum inlets which exist along the operational or working face of the cleaning head.

Gauges

The figures also slow gauges 230 which preferably include a vacuum gauge connected to vacuum conduit 226, a compressed gas gauge connected to the compressed gas supply, and a cleaning fluid temperature gauge connected to the cleaning fluid supply manifold 218 or at some other appropriate location.

In addition to the gauges illustrated, the portable unit can incorporate a moisture sensor 801 (FIG. 19) which is preferably along the working face. More preferably the moisture sensor is mounted in a position or positions which are along a trailing portion of the working face after cleaning fluid application and vacuum removal of cleaning fluid and debris from the treated surface. The moisture sensor 801 is shown mounted within a vacuum inlet 248 which trails when the portable unit is pulled backward in the preferred operational manner.

Third Embodiment, Adjustable Cleaning Fluid Application

FIGS. 21–25 show an alternative fourth version of the invention. In general the portable unit incorporating the invention of FIGS. 21–25 is the same or very similar to that shown and described above, particularly in connection with the second embodiment and similar reference numbers have been used where the parts are the same or very similar.

The fourth embodiment differs from the second and third embodiments because it includes a cleaning fluid application subsystem which is adjustable to vary the angle, position, direction and reflection of the cleaning fluid jet striking the carpet or other floor. Other differences in the preferred embodiment will now be described in greater detail.

FIG. 21 shows a cleaning fluid applicator 302 which is advantageously mounted to the rearward or back side of the working area, but could be alternatively placed at the front with modifications. The applicator advantageously includes a container or chamber wall which substantially encloses the internal components of the cleaning fluid applicator. The upper surface of the applicator chamber wall is advantageously provided with an observation port fitted with a window 320 through which the action of the cleaning fluid applicator can be viewed.

Adjustable Cleaning Fluid Applicator Nozzle

Applicator 302 also includes a cleaning fluid application nozzle or nozzles 306. Nozzles 306 are supported by a support member in the form of a threaded rod 312. The support rod is threaded to allow adjustment of the rod extension or retraction relative to a support mount. As shown, the nozzle support mounts are ball-shaped mounts which can be moved within a mounting ring 310. Mounting ring 310 receives the ball mounts in a manner allowing the ball to be reoriented both up and down and laterally. This action combined with the adjustment of rod 312 within a threaded aperture formed in ball 308 provides a wide range of positioning and orientation options. A handle 304 is attached to rod 312 to facilitate threaded or other axial position adjustment, and to facilitate changes in attitude and yaw.

Strike Pan

FIGS. 21–25 also show that the cleaning fluid applicator 302 preferably has an adjustable strike pan 315. Strike pan 315 is integral with or suitably connected to a secondary pan section 314. The strike pan is mounted for slidable motion relative to the applicator housing.

The strike pan adjustor includes a ball mount 308 which is pivotable within a mounting ring 310. A strike pan adjustment rod is threadably received through ball 308 and is extendible and retractable axially to extend and retract the strike pan 315. There are preferably two of the ball mounts connected to the strike pan assembly, one along one side of the cleaning head and the other along the opposite side of the cleaning head. This configuration also allows the leading edge of the strike pan to be angled relative to the cleaning fluid application chamber if desired for some reason.

Strike Pan Guide

FIGS. 21–25 also show that the preferred contruction for the adjustable strike pan also includes a strike pan guide assembly 318. The strike pan guide assembly includes a guide plate which is connected between forward and rearward guide bars 321. Each guide bar has a guide extension 310 which is received with a groove 316 (FIG. 24) so as to allow the guide plate to move forward and rearward maintained in groove or slot 316. The groove 316 is formed in the guide members 323 which are advantageously mounted to the applicator housing in a fixed position. Groove 316 determines the direction of movement of the strike plate assembly because the strike pan assembly is connected to the guide 318, as shown in FIG. 25. Alternative constructions may not require such connection.

Applicator Outlet Port

FIG. 21 illustrates that the cleaning fluid applicator has an application port or ports 391 through which the jet or jets of cleaning fluid are directed. The strike pan 315 is adjacent to the application port 391. Cleaning fluid is directed to the port and a portion or all of the jets of cleaning fluid is reflected and scattered by the strike pan and adjacent areas of the application port. This provides redirection of the cleaning fluid into a range of orientations, but generally the jets emitting through port 391 are directed horizontally to help remove dirt and oils from carpet fibers that are layed horizontally by the weight of the cleaning head pressing down upon the carpet.

It is also noteworthy that the cleaning fluid jets are directed so that the velocity of the cleaning fluid is generally in countervailing direction to the flow of heated drying gas which passes under dividing wall 242 and up through vacuum chamber 250. This is believed to be helpful in causing both the heated drying gas and liquid to move axially along the carpet fibers from the base thereof toward the distal ends of the fibers. Thus, both the cleaning fluid jets and the drying gas aid in stripping dirt and oil from the carpet fibers. This is most preferably done in direction that lies generally along the fiber and in aid of the rush of air and drying gas passing into the vacuum chamber. This combination is believed helpful in achieving improved results in removing soil, stains, and debris from the carpet fibers.

Fourth Embodiment

FIGS. 26 and 27 show a slightly modified fourth version of the invention. The same reference numbers have been used to identify the same or similar parts as used in the second and third embodiments. Additional features and differences will now be described.

FIG. 26 indicates that the preferred portable unit 200 shown in this embodiment has a wider cleaning head and associated wider working area. Specifically the cleaning head front 209 is larger, both wider and higher. Otherwise the fourth embodiment as shown in FIG. 26 is similar.

FIG. 27 shows a cross-sectional view of the internal configuration of the fourth embodiment. The drying gas chamber 247 has been provided with a front deflector-guide 372 and a rear deflector-guide 373. The preferred deflector-guides extend across the width of the drying gas chamber working opening which discharges drying gas to the carpet surface. The deflector-guides 372 and 373 converge toward the discharge port and thus increase the velocity of the drying gas as it emits from the drying gas chamber exhaust port. The increased velocity causes improved penetration of the drying gas into the carpet.

The deflector-guides include guide portions which are generally parallel or along the carpet surface. These extend from the nose of the guides toward the vacuum intake chambers 248 and 250. The relatively thin passage defined between the lower guide surfaces and the carpet cause a further acceleration of the drying gas to increase the velocity. This increased velocity creates an updraft effect according to the venturi effect which appears to aid in drawing water upwardly and out of the carpet.

FIG. 27 also shows that the compressed gas manifolds 246 have their nozzle holes 247 directed at the deflector-guide noses 375. This is done to help scatter the jets of compressed gas which are emitted therefrom and provide more even agitation and drying effect across the drying gas portion of the working face.

FIG. 27 further shows a vacuum low control valve 403. As illustrated valve 403 is a throttle valve which pivots upon pivot axis 405. The pivot axis 405 can be connected to a thermostat, manual control or automatic control operator (not illustrated) to throttle the vacuum applied to vacuum plenum 249. This is most useful in helping to control the temperature achieved in the vacuum inlets and across the working face of the cleaning head. If higher temperatures are achieved then drying is aided. However, throttling of the vacuum will reduce flow rates. At some point these considerations balance to provide preferred operational performance.

Although valve 403 is illustrated as a throttle valve which is positioned within the vacuum conduit, it is alternatively possible to use other types of valves. One example of an alternative valve is a pinch valve having sidewalls which can be constricted to reduce the flow area and flow rate through the vacuum exhaust conduit.

It should also be understood that the upper end of the vacuum exhaust conduit 226 can also be provided with a vacuum adjustment or relief valve 485 which allows ambient air to be bled into the vacuum to provide a relatively static reduction or increase in the vacuum developed in the chamber. This can be used to compensate for hose lengths or other factors which affect the vacuum developed from one location to another, or from one machine to another.

Accessory Lighting and Obseration

The cleaning fluid chamber can advantageously be provided with one or more illumination lights 802 which allow better viewing through the optional viewing window 320 (FIG. 27).

Additional viewing can be provided by providing all or part of vacuum tube 226 in a form having a transparent wall or wall portions. Illumination (not shown) can also be included to aid such viewing.

Further, the drying gas chamber can be provided with a suitable viewing window which can also be aided by illumination. The window can be along one or both ends of the cleaning head.

Fifth Embodiment

FIG. 28 shows a diagrammatic presentation of a combined system according to the invention. The combined system includes a support unit 500 and a portable unit 600.

Support Unit

The support unit preferably includes an air compressor 508 which supplies compressed air through compressed gas line 506. If desired, an ozone generator 518 is used as a deodorizing additive which is introduced into the compressed gas line using venturi 507. Other additives can be added by additive dispenser 528, for example fragrances or other additive gases.

Support unit 500 also has a cleaning fluid reservoir 617 which can include heated water, soap, surfactants, degreasing agents, and other solutions or mixtures found suitable for cleaning carpets or other surfaces being cleaned.

The cleaning fluid reservoir 617 supplies cleaning fluid to a cleaning fluid pump 619 or other supply mechanism and then the cleaning fluid is sent to the portable unit, such as via fitting 231 of FIG. 13.

The vacuum system part of the support unit includes a vacuum generator 625 and a vacuum waste receptacle 632. The vacuum flow passed through conduit 226 discharges into the waste receptacle and the waste receptacle can be according to a variety of known designs.

The support unit 500 can be used with any of the portable units described herein. It may also incorporate any of the features of the other base units or support units described above for vehicular mounting or otherwise, in addition to or as alternative to the features shown in this embodiment.

Portable Unit

FIG. 28 also shows diagrammatically a portable unit which is representative of the portable units or cleaning units described elsewhere herein. It may also incorporate any of the features of the other portable units in addition to or as alternative to the features shown in this embodiment.

All of the components of the portable unit 600 have been described hereinabove and the structural relationships have also been indicated. Thus the configuration of portable unit 600 will not be repeated.

Further Methods and Operation

The invention further includes a number of novel methods and operational features and aspects. Description will now be given detailing further aspects which should be taken in combination with the other description given herein. The various methods, procedures and operating capabilities described with regard to one, more than one, or all embodiments can be individually or in combination added to or used to modify this description further as exemplary of additional forms and embodiments of this invention.

Additional methods according to this invention include applying a cleaning fluid by redirecting the cleaning fluid stream against one or more redirecting surfaces. The strike pan described hereinabove is one structure for redirecting.

The redirecting of the cleaning fluid stream is preferably done so as to allow adjusting of the stream or redirecting surface or surfaces to achieve varying degrees of reflection or scattering of the cleaning fluid stream. This can be done by advancing or retracting the strike pan or similar redirecting surface.

The redirecting or alternatively directing of cleaning fluids along the surface also preferably results in the case of carpeting that the cleaning fluids are oriented properly to perform by traveling along the length of the general direction of the carpet fibers. This preferably done by directing or redirecting the cleaning fluids into the carpet so as to impinge near the base end of the carpet fibers and proceed along the fibers toward the distal ends thereof. This tends to free dirt and oil from the fibers and to better dislodge debris which is between the carpet fibers.

The directing or redirecting of the cleaning fluid stream or streams also is advantageously performed by directing such cleaning fluid in countervailing direction to drying or compressed gas emitted against the treatment surface. This tends to further subject the carpet fibers to increased activity and better vacuum removal of the debris and any, cleaning fluids applied. In this regard the compressed gas and drying gas can advantageously be streamed in the same general direction, which is preferably toward the vacuum inlet or inlets. By directing or redirecting the cleaning fluids from a position outboard of the vacuum chamber and supplying drying gas from a position opposite from the directing, then good performance can be obtained.

Methods of this invention may also include applying a treatment additive to the surface being treated by directing a treatment chemical or chemical through the working face and against the surface being cleaned, dried or otherwise treated.

The applying of treatment chemicals is advantageously accomplished by infusing the treatment chemical into a gas stream directed at the treated surface via the working face. This can be done using the compressed gas stream such as described above. The infusing can occur into the gas stream in the support unit or in the portable unit. The infused treatment chemical can be of various forms, more preferably in the form of a gas or liquid. If liquid treatment additives are used, then they are preferably rendered into small particle sizes such as by atomizing the additive. This can be done in a number of ways, such as the atomizing oilers described hereinabove or other means for atomizing the additive.

The invention may further include methods which involve deflecting drying gas at the drying gas application opening. This is preferably done by using deflectors such as the deflector-guides described above. The deflector or deflectors preferably narrow the opening through which drying gas is emitted against the carpet or other surface being treated.

Methods according to the invention may also involve guiding the drying gas along a guide surface which run parallel or otherwise along the surface. This guiding is preferably performed so as to accelerate the velocity of the drying and any other gases. This can result in reducing the static pressure of the flowing gas as it passes along the surface to thus induce fluids to migrate from the carpet or other surface.

The deflecting of gas can advantageously also involve deflecting streams of compressed gas which are directed from the working face and against the carpet or other surface being treated. This is advantageously done by directing a stream or streams of compressed gas against the deflectors and thus scattering, diffusing and further agitating the compressed gas and drying gas being emitted against the surface being treated.

Methods according to the invention can also involve moving the vacuum treatment head over the surface being treated. This is advantageously done in a backward direction when cleaning fluid is applied along the backward side of the working face. This allows application of the cleaning fluid to the carpet or surface along a leading edge of the working face. The cleaning liquid thus performs by impinging, washing and solubilizing dirt and oils which may be present.

Further methods may include agitation of the treated surface using a compressed gas by directing a stream or streams of the compressed gas from the working face toward the treated surface to preform by agitating the surface and fibers attached thereto. The directing of compressed gas may also perform by loosening dirt and debris from the treated surface. Further the methods may result in volatilizing any cleaning fluids by directing the compressed gas from the working face against the treated surface.

Methods may further include various other steps and processes described herein either singularly or in combination with one or more other steps or processes described herein or apparent from the illustrations which accompany and form a part of this specification.

Manner of Making

The invention is preferably manufactured using preexisting metal and plastic working techniques. The portions exposed to higher temperatures are preferably made from metal and such is indicated by the section lines.

The cleaning head housing may advantageously be cast from aluminum or some other suitable material which is heat resistant and durable. The cleaning head housing may be cast in one piece or two pieces as shown and then fabricated, such as by welding the parts together. The remaining parts are affixed or mounted upon the assembly using typical mechanical fastening techniques. Alternatively, the cleaning head may be cast, fabricated or otherwise produced using a single or multiple parts.

FIGS. 15 and 16 show that the vacuum and drying gas chambers can be formed from two pieces 208 and 209. The first piece 208 has depending interior partition walls 242 which separate vacuum and drying gas. A port 244 is provided in second part 209 to allow vacuum to pass from the front vacuum inlet 248 to the vacuum plenum 249 and conduit 226.

Further Explanation of Aspects of the Invention

The invention has been described with regard to a number of features, steps, functions and other aspects. One or more of these are characteristic of the invention. Below is a listing of certain aspects and combinations of such aspects. Although the following groups certain aspects, it is intended that any one of the listed aspects and other features of the inventions described elsewhere herein may be significant in characterizing the invention.

A vacuum system cleaning head, comprising:

a vacuum housing having a vacuum intake on a working face of the cleaning head and connecting to a vacuum conduit;

a drying gas housing including a drying gas discharge adjacent to the vacuum intake on said working face;

at least one compressed gas applicator positioned within the cleaning head and including at least one discharge opening oriented to direct compressed gas from the working face of the cleaning head.

The vacuum system cleaning head including one or more of the above features wherein the working face has a perimeter wall.

The vacuum system cleaning head including one or more of the above features wherein the working face has a perimeter wall and at least one dividing wall between the vacuum intake and the drying gas discharge.

The vacuum system cleaning head including one or more of the above features wherein the working face has at least one dividing wall between the vacuum intake and the drying gas discharge.

The vacuum system cleaning head including one or more of the above features wherein the compressed gas applicator includes a pair of discharge conduits and wherein each discharge conduit includes a number of said discharge openings.

The vacuum system cleaning head including one or more of the above features wherein the compressed gas applicator includes an additive infuser which places an additive into the compressed gas being emitted from the compressed gas applicator.

The vacuum system cleaning head including one or more of the above features further comprising a drying gas heater on the cleaning head for heating drying gas discharged through the drying gas discharge.

The vacuum system cleaning head including one or more of the above features further comprising:

a drying gas heater on the cleaning head for heating drying gas discharged through the drying gas discharge;

a drying gas blower on the cleaning head for blowing drying gas through the drying gas discharge.

A vacuum system cleaning head, comprising:

a vacuum housing having a vacuum intake on a working face of the cleaning head and connecting to a vacuum conduit;

a drying gas housing including a drying gas discharge adjacent to the vacuum intake on said working face;

at least one compressed gas applicator positioned within the cleaning head and including at least one discharge opening oriented to direct compressed gas out the working face;

a cleaning fluid discharge positioned to discharge cleaning fluid from the working face of the cleaning head.

The vacuum system cleaning head including one or more of the above features wherein the working face has a perimeter wall.

The vacuum system cleaning head including one or more of the above features wherein the working face has a perimeter wall and at least one dividing wall between the vacuum intake and the drying gas discharge.

The vacuum system cleaning head including one or more of the above features wherein the working face has at least one dividing wall between the vacuum intake and the drying gas discharge.

The vacuum system cleaning head including one or more of the above features wherein the compressed gas applicator includes a pair of discharge conduits and wherein each discharge conduit includes a number of said discharge openings.

The vacuum system cleaning head including one or more of the above features wherein the compressed gas applicator includes an additive infuser which places an additive into the compressed gas being emitted from the compressed gas applicator.

The vacuum system cleaning head including one or more of the above features further comprising a drying gas heater on the cleaning head for heating drying gas discharged through the drying gas discharge.

The vacuum system cleaning head of including one or more of the above features further comprising:

a drying gas heater on the cleaning head for heating drying gas discharged through the drying gas discharge;

a drying gas blower on the cleaning head for blowing drying gas through the drying gas discharge.

A vacuum cleaning system, comprising:

a vacuum housing having a vacuum intake on a working face of the cleaning head and connecting to a vacuum conduit;

a drying gas housing including a drying gas discharge adjacent to the vacuum intake on said working face;

at least one compressed gas applicator positioned within the cleaning head and including at least one discharge opening oriented to direct compressed gas from the working face;

a vacuum generator adapted for connection to the vacuum conduit to supply vacuum to the vacuum intake;

a compressed gas supply adapted for connection to the at least one compressed gas applicator.

The vacuum cleaning system of including one or more of the above features wherein the working face has a perimeter wall.

The vacuum cleaning system including one or more of the above features wherein the working face has a perimeter wall and at least one dividing wall between the vacuum intake and the drying gas discharge.

The vacuum cleaning system including one or more of the above features wherein the working face has at least one dividing wall between the vacuum intake and the drying gas discharge.

The vacuum cleaning system including one or more of the above features wherein the compressed gas applicator includes a pair of discharge conduits and wherein each discharge conduit includes a number of said discharge openings.

The vacuum cleaning system including one or more of the above features wherein the compressed gas applicator includes an additive infuser which places an additive into the compressed gas being emitted from the compressed gas applicator.

The vacuum cleaning system including one or more of the above features further comprising a drying gas heater on the cleaning head for heating drying gas discharged through the drying gas discharge.

The vacuum system cleaning head including one or more of the above features further comprising:

a drying gas heater on the cleaning head for heating drying gas discharged through the drying gas discharge;

a drying gas blower on the cleaning head for blowing drying gas through the drying gas discharge.

A vacuum cleaning system, comprising:

a portable unit laving a frame, an operator interface connected to the frame that is operated by an operator, and a cleaning head;

a vacuum housing forming a vacuum intake leading from a working face of the cleaning head to a vacuum supply;

a drying gas housing including a drying gas discharge adjacent to the vacuum intake on said working face;

at least one compressed gas applicator positioned within the cleaning head and including at least one discharge opening oriented to direct compressed gas out the working face;

a cleaning fluid applicator on the cleaning head for applying cleaning fluids to the working face of the cleaning head;

a support unit adapted for being located at a location removed from the from the portable unit;

a vacuum generator on the support unit and forming part of the vacuum supply and adapted to be connected to the vacuum intake;

a compressed gas supply on a support unit adapted for connection to the at least one compressed gas applicator;

a cleaning fluid supply on the support unit for supplying cleaning fluid to the portable unit and cleaning fluid applicator.

A vacuum system cleaning head, comprising:

a vacuum housing having a vacuum intake on a working face of the cleaning head and connecting to a vacuum conduit;

at least one compressed gas applicator positioned within the cleaning head and including at least one discharge opening oriented to direct compressed gas from the working face of the cleaning head;

an additive infuser which places an additive into the compressed gas being emitted from the compressed gas applicator.

A vacuum system cleaning head including one or more of the above features wherein the additive infuser places an atomized additive into the compressed gas.

A vacuum system cleaning head including one or more of the above features wherein the additive infuser is mounted upon the cleaning head.

A vacuum cleaning head, comprising:

a vacuum housing having a vacuum intake on a working face of the cleaning head and connecting to a vacuum conduit;

a cleaning fluid discharge positioned to discharge cleaning fluid from the working face of the cleaning head;

a cleaning fluid strike pan connected to the vacuum cleaning head along the working face so that at least a portion of cleaning fluid discharged from the cleaning fluid discharge is redirected to change the angle of incidence relative to the working face.

A vacuum cleaning head including one or more of the above features wherein the cleaning fluid strike pan is adjustable relative to the cleaning head to vary fluid discharge from the working face.

A method for vacuum cleaning surfaces, such as floors, carpets and other surfaces being cleaned, comprising:

forming a working area along a face of a cleaning head when the cleaning head is placed in an operational position facing a surface being cleaned;

applying pressurized drying gas against the surface being cleaned from the working area;

infusing a treatment additive with the pressurized drying gas and applying the treatment additive therewith.

A method for vacuum cleaning including one or more of the above features and wherein said infusing includes atomizing a liquid treatment additive.

A method for vacuum cleaning including one or more of the above features and further comprising discharging a cleaning fluid within the working area and applying said cleaning fluid to the surface being cleaned.

A method for vacuum cleaning including one or more of the above features and further comprising heating drying gas and suppling the drying gas to the working area.

A method for vacuum cleaning including one or more of the above features and further comprising:

discharging a cleaning fluid within the working area and applying said cleaning fluid to the surface being cleaned;

heating drying gas supplied in said providing step;

evacuating to remove cleaning fluid and drying gas to assist in drying the surface being cleaned.

A method for vacuum cleaning including one or more of the above features and further defined by passing the pressurized drying gas over at least one zone partition wall.

A method for vacuum cleaning surfaces, such as floors and carpets, comprising:

forming a working area along a face of a cleaning head when the cleaning head is placed in an operational position facing a surface being cleaned;

discharging a cleaning fluid against a strike pan to redirect and diffuse cleaning fluid being applied.

General and Interpretational Explanation

Various forms and aspects of the invention have been described. It should also be understood that the invention may in alternative forms include one or more of the aspects or features shown in one embodiment implemented into another embodiment. Thus the various combinations of features shown herein can be combined in such alternative ways to further set out alternative forms of the invention.

The invention has been described in compliance with the statute. In doing so the invention has necessarily been described in language more or less specific as to structural and methodical features. It is to be understood, however, that the invention is not limited to the specific features shown and described, since the features and methods disclosed herein comprise preferred forms of putting the invention into effect, and cannot describe all options for implementation. The invention is, therefore, claimed in any of its forms or modifications within the proper scope of the appended claims appropriately interpreted in accordance with the doctrine of equivalents.

I claim:

1. A vacuum cleaning head, comprising:

a vacuum housing having a vacuum intake on a working face of the cleaning head and connecting to a vacuum conduit;

a cleaning fluid discharge positioned to discharge cleaning fluid from the working face of the cleaning head;

a cleaning fluid strike pan connected to the vacuum cleaning head along the working face so that at least a portion of cleaning fluid discharged from the cleaning fluid discharge is redirected to change the angle of incidence relative to the working face;

wherein the cleaning fluid strike pan is adjustable relative to the cleaning head to vary fluid discharge from the working face.

* * * * *